US007018761B2

(12) United States Patent
Yamanouchi et al.

(10) Patent No.: US 7,018,761 B2
(45) Date of Patent: Mar. 28, 2006

(54) TONER AND IMAGE FORMING METHOD

(75) Inventors: Takao Yamanouchi, Hachioji (JP); Masafumi Uchida, Hachioji (JP); Masahiro Anno, Sakai (JP); Chikara Tsutsui, Nishinomiya (JP); Takeshi Arai, Akashi (JP)

(73) Assignee: Konica Minolta Holdings, Inc., Tokyo (JP)

( * ) Notice: Subject to any disclaimer, the term of this patent is extended or adjusted under 35 U.S.C. 154(b) by 24 days.

(21) Appl. No.: 10/665,590

(22) Filed: Sep. 18, 2003

(65) Prior Publication Data

US 2004/0126692 A1 Jul. 1, 2004

(30) Foreign Application Priority Data

Sep. 19, 2002 (JP) ..... 2002-273210

(51) Int. Cl.
*G03G 9/08* (2006.01)

(52) U.S. Cl. ..... 430/108.4; 430/108.8; 430/110.3; 430/110.4; 430/111.4

(58) Field of Classification Search ..... 430/110.3, 430/110.4, 111.4, 107.1, 108.1, 108.4, 108.8
See application file for complete search history.

(56) References Cited

U.S. PATENT DOCUMENTS

2002/0037469 A1* 3/2002 Kohyama et al. ..... 430/110.3

OTHER PUBLICATIONS

Grant, R., et al, ed., *Grant & Hackh's Chemical Dictionary*, fifth edition, McGraw-Hill Book Company, NY (1987), p. 357.*

* cited by examiner

*Primary Examiner*—Janis L. Dote
(74) *Attorney, Agent, or Firm*—Lucas & Mercanti LLP

(57) ABSTRACT

A toner used for an image forming method comprises steps of: limiting an amount of toner on a surface of a toner carrier by allowing a toner layer limiting member to be pressed to the surface of the toner carrier; and developing an electrostatic latent image formed on an electrostatic latent image carrier using the toner carried and transferred by the toner carrier, based on a non-magnetic single component development system, wherein the toner comprises toner particles having a volume average particle diameter of 3 to 9 μm, an arithmetic mean value of shape factor of 1.1 to 1.5, a coefficient of variation of shape factor of 16% or less, a ratio of rounded toner particle of 50% by number or more and a coefficient of variation of number particle diameter distribution of 26% or less, and a conveyance index of 2.0 to 10.0.

24 Claims, 5 Drawing Sheets

ROUNDED TONER PARTICLE

ANGULAR TONER PARTICLE

ANGULAR TONER PARTICLE

TONER AND IMAGE FORMING METHOD

BACKGROUND OF THE INVENTION

1. Field of the Invention

The present invention relates to a toner and an image forming method.

2. Description of the Related Art

Recently, a system for forming color images based on electrophotographic system is used over a wide area covering use in office and light printings by virtue of its advantages in a fast printing speed and simplicity.

As the image forming method based on the aforementioned electrophotographic system, single component development systems using a single component developer solely composed of a toner are particularly preferably used because it needs no complicated configuration of the apparatus therefor.

Among color image forming method using a single component development system, a develop method using a non-magnetic single component development system is preferably used. In the non-magnetic single component development systems, one non-magnetic single component development system in which an electrostatic latent image formed on an electrostatic latent image carrier comprising an organic photosensitive material or the like, is visualized by a toner carried and transferred by a toner carrier to which a toner layer limiting member for limiting the amount of toner on the surface of the toner carrier is pressed, is utilized.

In the non-magnetic single component development system, because the toner is frictionally charged by the contact between the toner and the toner layer limiting member and/or the toner carrier, it is necessary to use a toner having an excellent frictional charging property, or to use a toner carrier capable of readily giving electric charge. It is also necessary to supplement the toner carrier with the toner consumed in the development, and to properly replace the toner which is remaining undeveloped on the toner carrier.

In order to satisfy these requirements, there is proposed a method of adding an electric charge providing material to a constituent of the toner carrier so as to add an appropriate charge provision property to the toner carrier (see Patent Document 1, for example), or a method of adding a specified electric charge providing material to a constituent of the toner carrier and of adding an external additive having a large particle diameter to an external additive for the toner (see Patent Document 2, for example).

Although the foregoing methods can successfully upgrade the charge provision property in the initial stage of use by improving constitution of the toner carrier, but raises a problem of causing changes in the surface property of the toner carrier due to abrasion or the like during a long-term use, and of consequently increasing changes in the charge provision property to the toner, is caused.

Moreover, in the case where a charge providing material having a strong influence on the constituents of the toner carrier is used, the toner strongly adheres to charged points ascribable to the charge providing material, and this results in fusion or filming which are causative of conveyance failure or charging failure. This degrades the toner carrier, and consequently makes it impossible to keep a stable charge provision property for a long duration of time.

In addition, still another problem resides in that the toner carrier is prevented from attaining a stable toner supply property by the degradation thereof. Therefore, the toner carrier cannot appropriately supply and/or replace the toner in a suitable method because of a long duration of use, and this consequently produces development ghost in the resultant image.

Meanwhile, as for the toner, there are proposed methods of solving the above-described problems by adding an appropriate external additive to the toner particle (see Patent Documents 3 to 5, for example).

Only the simple addition of the external additive to the toner particle, however, cannot exclude influences caused by a long-term stress, and cannot fully solve problems in frictional charging property and in generation of the development ghost. Moreover, for the case where fluidity of the toner was improved by simply adding a large amount of external additive, a problem arises in that the external additive may adhere to the latent image carrier to thereby cause fusion or filming on the toner carrier, or may induce formation of scratches.

There are also proposed methods of using a spherical toner, which is so-called, suspension-polymerized toner, so as to keep an excellent fluidity of the toner, to thereby reduce contamination of the toner carrier (see Patent Documents 6 to 9). A simple spherization of the toner, which is merely caused by controlling the shape thereof so as to improve the fluidity, may be successful in giving an excellent fluidity to the toner, but is unsuccessful in providing an appropriate frictional charging to the toner, and this typically makes it difficult for a supply roller or the like to supply the toner in a stable manner to the toner carrier. This also makes it difficult to uniformly provide electric charge to a thin toner film formed on the toner carrier. This still also makes it difficult to stably control the amount of toner because of a low-temperature/low-humidity atmosphere in which the amount of toner supplied to the toner carrier is excessively increased beyond a controllable limit, and a high-temperature/high-humidity atmosphere, or the differences between a status after a long-term use and a status in the initial stage of use.

This consequently raises a problem that the toner remaining on the toner carrier after passing over the development zone cannot be recollected from the toner carrier, or a new toner cannot appropriately be supplemented. Further, the problem that the amount of charge of the toner on the toner carrier is non-uniform and the development ghost is produced, is caused.

In color image formation using a color toner comprising at least one of a yellow toner, a magenta toner and a cyan toner, together with a black toner, the color toner is generally consumed in a larger amount due to a large pixel ratio of the color image. When the fluidity is increased in order to improve the feeding property of the toner, the toner is easily scattered on the text portion. Consequently, the reproducibility of the text and image quality in repetitive copying are caused. This problem most likely occurs when the development is repeated over a long period.

Patent Document 1:
Japanese Laid-Open Patent Publication No. 7-281475

Patent Document 2:
Japanese Laid-Open Patent Publication No. 9-127783

Patent Document 3:
Japanese Laid-Open Patent Publication No. 10-20546

Patent Document 4:
Japanese Laid-Open Patent Publication No. 9-80911

Patent Document 5:
Japanese Laid-Open Patent Publication No. 2000-194161

Patent Document 6:
PCT International Publication No. WO00/13063

Patent Document 7:
Japanese Laid-Open Patent Publication No. 8-305074

Patent Document 8:
Japanese Laid-Open Patent Publication No. 10-333356

Patent Document 9:
Japanese Laid-Open Patent Publication No. 5-289405

SUMMARY OF THE INVENTION

The present invention was conceived based on the above-described situations, and an object thereof is to provide a toner capable of stably producing images with excellent quality based on the non-magnetic single component development system.

Another object of the present invention is to provide an image forming method capable of stably producing images with excellent quality based on the non-magnetic single component development system.

In accordance with the first aspect of the invention, a toner used for an image forming method comprises steps of: limiting an amount of toner on a surface of a toner carrier by allowing a toner layer limiting member to be pressed to the surface of the toner carrier; and developing an electrostatic latent image formed on an electrostatic latent image carrier using the toner carried and transferred by the toner carrier, based on a non-magnetic single component development system, wherein the toner comprises toner particles having a volume average particle diameter of 3 to 9 μm, an arithmetic mean value of shape factor of 1.1 to 1.5, a coefficient of variation of shape factor of 16% or less, a ratio of rounded toner particle of 50% by number or more and a coefficient of variation of number particle diameter distribution of 26% or less, and a conveyance index of 2.0 to 10.0.

Preferably, the toner has a peak or shoulder respectively in a molecular weight distribution range from 100,000 to 1,000,000, and from 1,000 to 50,000.

Preferably, the toner contains external additives having different number average primary particle diameters.

Preferably, one of the external additives is a small-sized external additive having a number average primary particle diameter of 30 nm or less.

Preferably, one of the external additives is a large-sized external additive having a number average primary particle diameter larger than that of the small-sized external additive, and of 15 to 70 nm.

Preferably, the resin particle has a softening point of 90 to 140° C.

In accordance with the second aspect of the invention, An image forming method comprises the steps of:

limiting an amount of toner on a surface of a toner carrier by allowing a toner layer limiting member to be pressed to the surface of the toner carrier; and developing an electrostatic latent image formed on an electrostatic latent image carrier using the toner carried and transferred by the toner carrier, based on a non-magnetic single component development system, wherein the toner has a volume average particle diameter of 3 to 9 μm, an arithmetic mean value of shape factor of 1.1 to 1.5, a coefficient of variation of shape factor of 16% or less, a ratio of rounded toner particle of 50% by number or more and a coefficient of variation of number particle diameter distribution of 26% or less, and a conveyance index of 2.0 to 10.0.

Preferably, the toner has a peak or shoulder respectively in a molecular weight distribution range from 100,000 to 1,000,000, and from 1,000 to 50,000.

Preferably, the toner contains external additives having different number average primary particle diameters.

Preferably, one of the external additives is a small-sized external additive having a number average primary particle diameter of 30 nm or less.

Preferably, one of the external additives is a large-sized external additive having a number average primary particle diameter larger than that of the small-sized external additive, and of 15 to 70 nm.

Preferably, the resin particle has a softening point of 90 to 140° C.

In accordance with the third aspect of the invention, an image forming method comprises steps of:

limiting an amount of toner on a surface of a toner carrier by allowing a toner layer limiting member to be pressed to the surface of the toner carrier; and developing an electrostatic latent image formed on an electrostatic latent image carrier using the toner carried and transferred by the toner carrier, based on a non-magnetic single component development system, wherein the toner is obtained by a salting-out/fusion-adherence process of a resin particle and a colorant particle proceeded in a water-base medium, and has a volume average particle diameter of 3 to 9 μm, an arithmetic mean value of shape factor of 1.1 to 1.5, a coefficient of variation of shape factor of 16% or less, a ratio of rounded toner particle of 50% by number or more and a coefficient of variation of number particle diameter distribution of 26% or less, and a conveyance index of 2.0 to 10.0; and the toner carrier comprises a conductive base, and an elastic layer, an intermediate layer and a surface layer formed on the conductive base, wherein volume resistivity $\sigma 1$ of the elastic layer, volume resistivity $\sigma 2$ of the intermediate layer and volume resistivity $\sigma 3$ of the surface layer satisfy a relation of $\sigma 2 \leqq \sigma 1 \leqq \sigma 3$, and the toner carrier has an arithmetic mean roughness Ra of the surface of 0.8 to 2.5 μm.

Preferably, the toner has a peak or shoulder respectively in a molecular weight distribution range from 100,000 to 1,000,000, and from 1,000 to 50,000.

Preferably, the toner contains external additives having different number average primary particle diameters.

In accordance with the fourth aspect of the invention, an image forming method comprises steps of:

forming a color toner image comprising a color toner which contains at least one of a yellow toner, a magenta toner and a cyan toner, together with a black toner, on an intermediate transfer body by repeating a process of limiting an amount of toner on a surface of the toner carrier by allowing a toner layer limiting member to be pressed to the surface of the toner carrier, developing an electrostatic latent image formed on an electrostatic latent image carrier using the toner carried and transferred by a toner carrier based on a non-magnetic single component development system, and transferring the formed toner image to the intermediate transfer body, a plurality of number of times; and transferring and fixing the color toner image to an image support, wherein the toner composing the color toner image has a volume average particle diameter of 3 to 9 μm, an arithmetic mean value of shape factor of 1.1 to 1.5, a coefficient of variation of shape factor of 16% or less, a ratio of rounded toner particle of 50% by number or more and a coefficient of variation of number particle diameter distribution of 26% or less, and a conveyance index Cc of the color toner is 5.0 to 10.0, a conveyance index Bc of the black toner is 2.0 to 6.0, and a relation of Cc>Bc is satisfied.

Preferably, the toner has a peak or shoulder respectively in a molecular weight distribution range from 100,000 to 1,000,000, and from 1,000 to 50,000.

Preferably, the toner contains external additives having different number average primary particle diameters.

In accordance with the fifth aspect of the invention, an image forming method comprises steps of:

limiting an amount of toner on a surface of a toner carrier by allowing a toner layer limiting member to be pressed to the surface of the toner carrier for each of a plurality of electrostatic latent image carriers;

developing each electrostatic latent image formed on the electrostatic latent image carriers using the toner carried and transferred by the toner carrier, based on a non-magnetic single component development system;

forming a color toner image comprising a color toner which contains at least one of a yellow toner, a magenta toner and a cyan toner, together with a black toner by carrying out a primary transfer of the formed toner image to an intermediate transfer body and carrying out a secondary transfer of the color toner image and fixing the color toner to an image forming support, wherein the toner composing the color toner image has a volume average particle diameter of 3 to 9 μm, an arithmetic mean value of shape factor of 1.1 to 1.5, a coefficient of variation of shape factor of 16% or less, a ratio of rounded toner particle of 50% by number or more and a coefficient of variation of number particle diameter distribution of 26% or less, and a conveyance index Cc of the color toner is 5.0 to 10.0, a conveyance index of Bc the black toner is 2.0 to 6.0, and a relation of Cc>Bc is satisfied.

Preferably, the toner has a peak or shoulder respectively in a molecular weight distribution range from 100,000 to 1,000,000, and from 1,000 and 50,000.

Because the toner of the present invention has specific shape properties and conveyance index controlled within a specific range, it can form a thin toner layer which can be frictionally charged in a highly uniform manner on the toner carrier even under the non-magnetic single component development system. Further, it has an excellent supplemental property and replacement property with respect to the toner carrier.

The toner of the present invention can thus stably produce images with high quality based on the non-magnetic single component development system.

DETAILED DESCRIPTION OF THE PREFERRED EMBODIMENTS

The present invention will be explained in detail.

The toner of the present invention comprises toner particles having a volume average particle diameter of 3 to 9 μm, an arithmetic mean value of shape factor of 1.1 to 1.5, a coefficient of variation of shape factor of 16% or less, a ratio of rounded toner of 50 percent by number or more, and a coefficient of variation of number particle diameter distribution of 26% or less, and has a conveyance index of 2.0 to 10.0.

Figure 1:
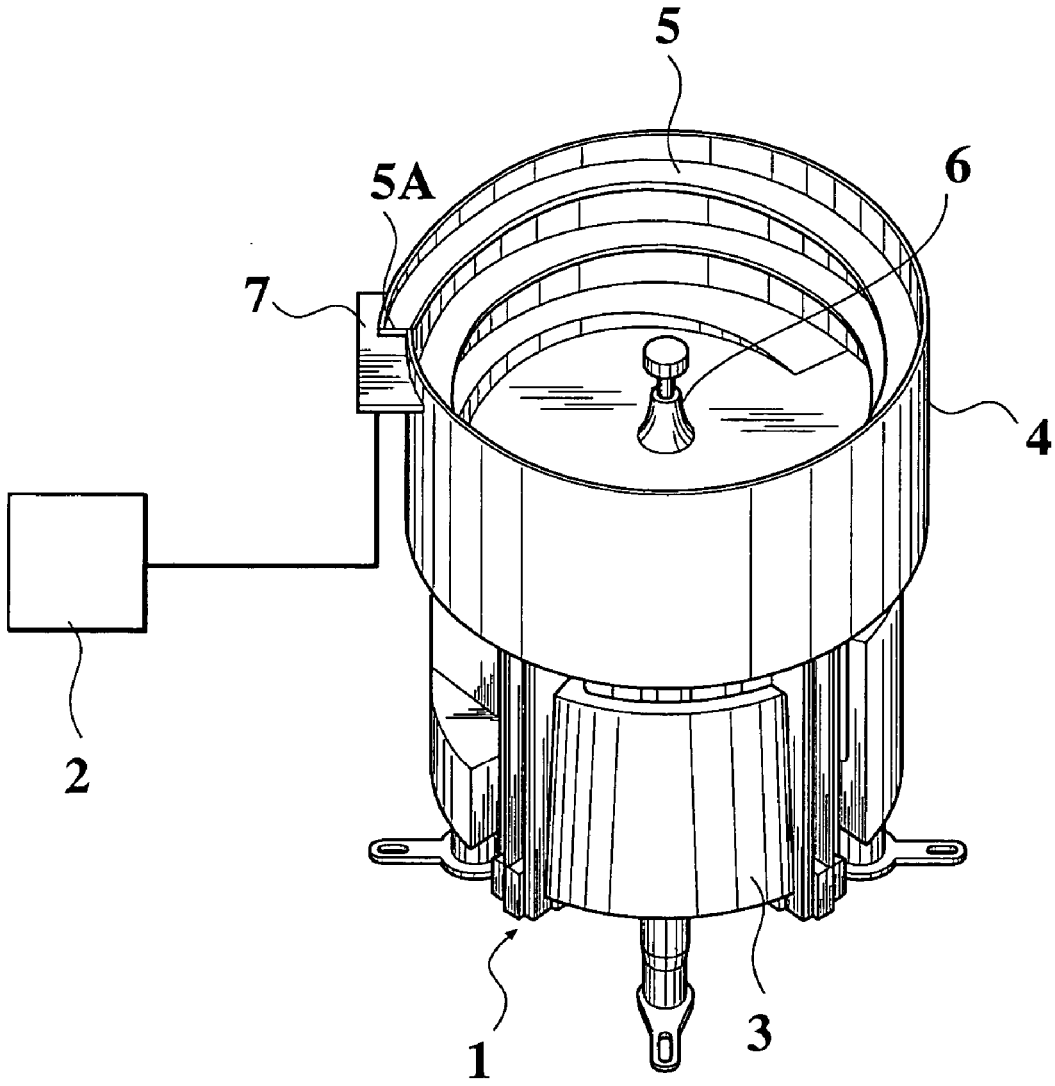
FIG. 1 is an explanatory schematic drawing showing one exemplary configuration of a parts feeder for measuring conveyance index of the toner.

"Conveyance index" described herein refers to an index of conveyance property of the toner particle typically obtained by measurement using the parts feeder shown in FIG. 1 under constant vibration, and expresses how readily the toner can be conveyed, or in other words, mobility of the toner.

It is to be noted that the conveyance index described herein is different from generally-speaking fluidity evaluated by static bulk density, angle of repose and the like measured under rest status of the toner.

More specifically as shown in FIG. 1, the parts feeder 1 comprises a driving source 3 for generating a specific vibration, and a cylindrical bowl 4 supported above the driving source 3. The bowl 4 has a spiral slope way 5 formed on the inner circumferential wall thereof so as to connect the bottom plane to the upper end rim.

The slope way 5 is disposed so that the upper end portion 5A thereof is projected out from the side wall of the bowl 4 outwardly in a radial direction at the same level of height as the upper end rim of the bowl.

In FIG. 1, reference numeral 6 represents the center axis of the bowl 4, reference numeral 7 represents a pan disposed below the upper end portion 5A of the slope way 5, and reference numeral 2 represents a weighing means connected to the pan 7.

In this parts feeder 1, rotation power is supplied from the driving source 3 to the bowl 4 and is converted into vibratory motion for making the bowl 4 vibrate as a whole. By changing the limiting positions of the vertical motion with the action of springs disposed at angles, the toner placed in the bowl 4 is transferred upwardly along the slope way 5 and drop from the upper end portion 5A of the slope way 5 into the pan 7.

In measurement of the conveyance index of the toner in the present invention, 1 g of the toner is put around the center axis 6 in the bowl 4, the driving source 3 is allowed to operate at a frequency of 120 rps and a voltage of 80 V, so as to transfer the toner upwardly along the slop way 5 to make it reach the pan 7. The amount of toner reached the pan 7 is weighed by the weighing means 2. The durations of time between the start of operation of the driving source 3 and the points of time when the amount of the toner reached the pan 7 is 300 mg and 750 mg, respectively, are measured, and the conveyance index is calculated by the general equation (1) below:

$$\text{Conveyance index} = \frac{(750 - 300)\ \text{mg}}{(T750 - T300)\text{sec}} \quad (1)$$

In the general equation (1), T300 is a time required for transferring 300 mg of the toner to the pan 7, and T750 is a time required for transferring 750 mg of the toner to the pan 7.

The conveyance index of thus obtained toner is within a range from 2.0 to 10.0, preferably within a range from 2.0 to 9.0, and more preferably within a range from 2.0 to 8.0.

If the conveyance index is less than 2.0, the toner tends to be transferred to the development zone only in a short time due to its excessively large fluidity. That is, because the amount of incorporation of the developer tends to be large in the development limiting portion, the toner cannot fully be charged and a weakly charged toner exists. This raises a problem of causing dusting or fogging during the image transfer, and prevents formation of sharp images.

On the other hand, if the conveyance index exceeds 10.0, the toner can surely be charged since duration of time before the toner is transferred to the development zone is sufficiently long. However, tracking failure may occur due to its poor transferability, and this may cause non-uniform image density. This is also causative of adhesion in the toner layer limiting member or the like in continuous copying, and results in white stream noise on a black background. A problem of reduction in the image density may also arise.

For the case where the color toner comprising at least one of a yellow toner, a magenta toner and a cyan toner is used together with a black toner, the conveyance index of the color toner (Cc) and the conveyance index of the black toner (Bc) should satisfy a relation of Cc>Bc, where the conveyance index of the black toner is within a range from 2.0 to 6.0, and the conveyance index of the color toner is within a range from 5.0 to 10.0.

For the case where all toners composing the color toners which are typically a total of three toners of a yellow toner, a magenta toner and a cyan toner, are used, it is necessary that all of these toners have specific conveyance indices (Cc).

The conveyance index of the black toner (Bc) preferably is within a range from 2.0 to 5.0, and the conveyance index of the color toner (Cc) preferably is within a range from 6.0 to 9.0.

The reasons thereof are as follows. Because an image composed of the color toners has a high pixel ratio and the image is formed by overlapping multiple colors, too small conveyance indices may fail in obtaining a desirable image quality due to scattering of the toner during fixation. Further, an area in which the toners are not fixed is likely to be caused. On the other hand, because the black toner is mainly used for monochromatic image formation having a relatively small area such as text portion, when the conveyance index thereof is too large, degradation at the limiting portion is promoted and image deterioration due to adhesion is caused.

The toner of the present invention has an arithmetic mean value of shape factor of 1.1 to 1.5, a coefficient of variation of shape factor of 16% or less, a ratio of rounded toner of 50 percent by number or more. This facilitates the conveyance index of the toner to be regulated within the specific range.

The reason thereof is not completely clear. However, because the toner particles composing the toner have certain irregular shapes, a desirable feeding property of the toner can be maintained without extremely enhancing the transferability.

Adjustment of a coefficient of variation of number particle diameter distribution of the toner to 26% or less is successful in sharpening the particle diameter distribution of the toner, and is consequently successful in controlling the conveyance index of the toner within a specific range.

A wide particle diameter distribution of the toner herein means that the toner contains a quantity of toner particles differing in the transferability from each other, and this consequently makes it impossible to control the conveyance index within a certain range.

The "shape factor" of the toner of the present invention is a value for expressing a degree of roundness of the toner particle, and is given by the equation below:

$$\text{Shape factor} = ((\text{maximum diameter}/2)^2 \times \pi)/\text{projected area}$$

In this equation, maximum diameter refers to a width of the particle, which gives a maximum distance between two parallel lines drawn so as to sandwich a projected image of the toner particle, which is formed on a plane. The projected area herein means an area of the projected image of the toner formed on a plane.

In the present invention, the arithmetic mean value of the shape factors was measured by taking a photograph of the toner particles at a 2,000× magnification under a scanning electron microscope, and by analyzing the obtained photograph using the "SCANNING IMAGE ANALYZER" (product of JEOL). The shape factors of 100 toner particles are obtained herein by calculation using the equation in the above, and the arithmetic mean value thereof is obtained.

The "coefficient of variation of shape factor" of the toner of the present invention is calculated by the equation below:

$$\text{Coefficient of variation of shape factor} = (S_1/K) \times 100\ (\%)$$

where $S_1$ represents standard deviation of shape factors of 100 toner particles, and K represents an average value of the shape factors.

To control the coefficient of variation of shape factor and the foregoing shape factor of the toner in a highly uniform manner without the variation lot by lot, it is also desirable to monitor characteristics of the toner particle (colorant particle) under formation in the salting-out/fusion-adherence process and in ageing in order to determine an appropriate timing for termination of the process.

The "monitoring" described herein means that a measuring instrument is incorporated in-line, and based on the measure results, any process conditions are controlled. For example, in a case that the shape measurement is incorporated in-line and that a polymerized toner is formed by associating or fusing the resin particles in a water-base medium, sampling is sequentially carried out in the fusion process or the like and each shape and particle diameter of the particles is measured. The reaction can be terminated when a desired shape is achieved.

While there are no special limitations on the monitoring method, a flow particle image analyzer FPIA-2000 (product of Toa Medical Electronics Co., Ltd.) is available. This analyzer is convenient since the shape can be monitored by carrying out an image processing in a real time while allowing the sample to flow. In other words, in the analyzer, a pump or the like is used in the reaction field and the shape of the particle is measured by continuous monitoring. Then, the reaction is terminated when a desired shape is achieved.

Figure 2A:
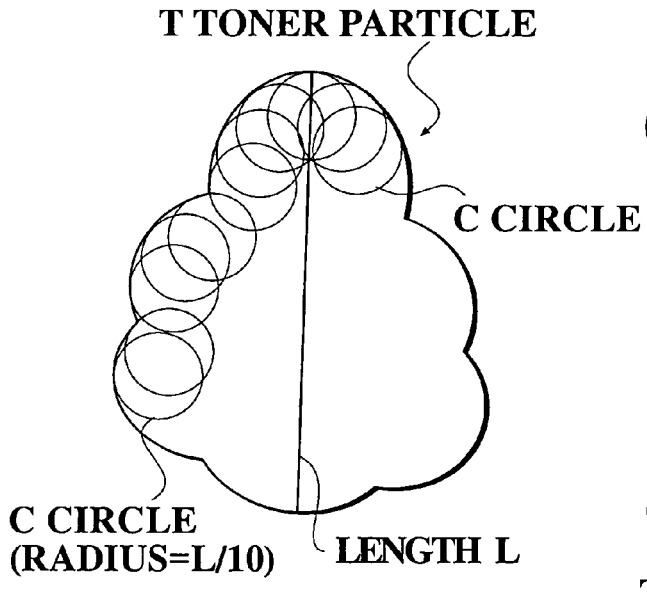
FIG. 2A is an explanatory drawing of a projected image of a rounded toner particle.

As for the toner of the present invention, "rounded toner particle" refers to a toner particle substantially having no projected portions, and more specifically to a toner particle defined as below. That is, as shown in FIG. 2A, in case that the length of a toner particle T is L, the toner particle is judged as a "rounded toner particle" when a circle C having a radius of L/10 is rolled along the peripheral line of the toner particle T inside thereof while the circle is inscribed with the peripheral line of the toner particle T at one point, and when the circle C substantially does not go beyond the peripheral line of the toner particle T. A case that "the circle C substantially does not go beyond" herein is a case that the particle has only one projection in which the circle can goes beyond the peripheral line.

The "length of toner particle" refers to a width of the particle, which gives a maximum distance between two parallel lines drawn so as to sandwich a projected image of the toner particle, which is formed on a plane.

Figure 2B:
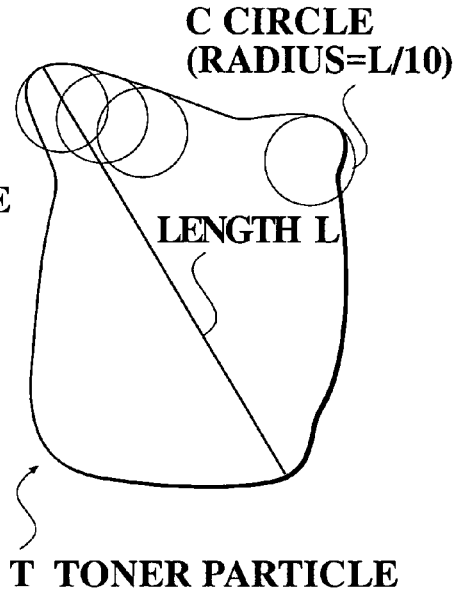
FIGS. 2B and 2C are explanatory drawings of projected images of angular toner particles.
Figure 2C:
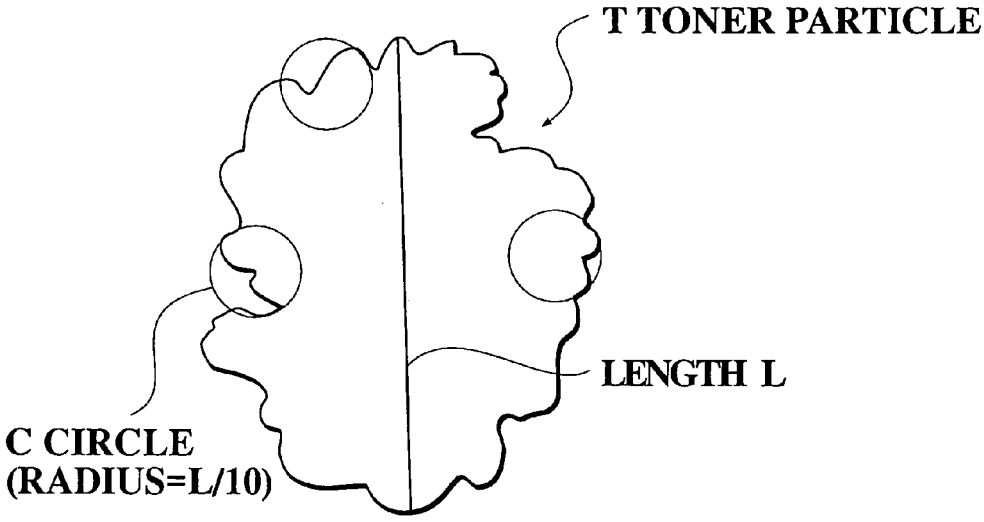

FIGS. 2B and 2C respectively show a projected image of an angled toner particle.

Ratio of rounded toner particle is preferably 70 percent by number.

In the present invention, ratio of the rounded toner particle was measured as follows.

First, a photograph of enlarged view of the toner particle is taken by a scanning electron microscope, and the view is further enlarged to obtain a photographic image at a 15,000× magnification. On this photographic image, presence or absence of the foregoing angle is measured. The measurement was carried out for 1,000 toner particles.

<Coefficient of Variation of Number Particle Diameter Distribution of Toner>

Number particle diameter distribution of the toner and coefficient of variation thereof used in the present invention can be measured using either of COULTER COUNTER TA-II or COULTER MULTISIZER (manufactured by Coulter, Inc.). The COULTER MULTISIZER connected with a personal computer through an interface manufactured by Nikkaki Co., Ltd., for outputting the particle diameter distribution is used. An aperture of 100 μm was used in the COULTER MULTISIZER, and the particle diameter distribution and average particle diameter were calculated by measuring volume diameter and number diameter of the toner having a diameter of 2 μm or larger. The number particle diameter distribution herein refers to a value for expressing relative frequency of the toner particles with respect to the particle diameter. The number average particle diameter is a value for expressing a particle diameter at a cumulative ratio of 50%, or Dn50, in the particle diameter distribution. The "coefficient of variation by number in the number particle diameter distribution" of the toner can be calculated by the equation below:

$$\text{Coefficient of variation by number} = [S_1/D_n] \times 100$$

where $S_1$ represents standard deviation in the number particle diameter distribution, and $D_n$ represents number average particle diameter (μm).

$$\text{Coefficient of variation by number} = [S_1/D_n] \times 100$$

where $S_1$ represents standard deviation in the number particle diameter distribution, and $D_n$ represents number average particle diameter (μm).

There are no special limitations on the method of controlling the coefficient of variation by number of the toner of the present invention. While the toner can be classified by air blow, in-liquid classification is more effective in view of minimizing the coefficient of variation by number. In one exemplary method of the in-liquid classification, a centrifugal separator is used. The toner particles are classified by controlling the speed of rotation of the centrifugal separator in accordance with the difference in the sedimentation speeds, which is caused by the difference in the particle diameter. Then, the toner is prepared.

To adjust the conveyance index of the toner of the present invention within a specified range, it is preferable that the colorant particle comprising at least a resin and a colorant is added with an external additive having a small particle diameter (also referred to as "small-sized external additive", hereinafter) and an external additive having a large particle diameter (also referred to as "large-sized external additive", hereinafter). These external additives are preferably added by multi-step mixing technique in which the small-sized external additive and the large-sized external additive are added in this order.

Addition of the external additives ensures that the fluidity of the toner particle itself is improved by the small-sized external additive, and that the adhesiveness of the toner particles is lowered, that is, so-called spacer effect is obtained by the large-sized external additive. Therefore, the toner particles can maintain a constant fluidity and a proper inter-particle cohesion property, and the conveyance index of the toner can be controlled within a certain range.

The external additives preferably adhere on the surface of the toner particle in a uniform manner. However, in the case where a plurality of particles having different particle diameters (also referred to as "multi-diameter particles", hereinafter) are used as the external additives, the external additives can uniformly be adhered on the surface of the toner particle by mixing the individual external additives by the multi-step mixing technique having two or more steps, which is described in the above.

More specifically, for the case where the external additives comprising the multi-diameter particles are added to the toner, because the fluidities of the individual particles composing the multi-diameter particles are different from each other, the stress applied to the external additives are different. As a result, in a case that the external additives composing the multi-diameter particles" are added under a constant condition, the external additives cannot uniformly adhere on the surface of the toner particle. It is therefore preferable to adopt the multi-step mixing technique in which the large-sized external additive is added and mixed after the small-sized external additive was added and mixed.

More specifically, it is necessary that the inter-particle cohesion of the particles is loosened to a certain extent, because the cohesive property among the particles composing the small-sized external additives is strong. On the other hand, in case that the large-sized external additive and the small-sized external additives are added at the same time, the function of the large-sized external additive is lowered by causing a phenomenon that the small-sized external additive is adhered on the surface of the large-sized external additive. It is thus considered that the external additives comprising the small-sized external additive and large-sized external additive can uniformly be adhered on the surface of the colorant particle by adding and mixing of the large-sized external additive having a smaller cohesive property as compared with that of the small-sized external additive to this system after the small-sized external additive is added and mixed so as to loosen the cohesion and to increase the fluidity.

The amount of addition of the small-sized external additive is preferably 0.1 to 5.0 wt % for the colorant particle.

The amount of addition of the large-sized external additive is preferably 0.1 to 5.0 wt % for the colorant particle.

For the case where the small-sized external additive and large-sized external additive are used in combination, the ratio of the amounts of addition of these additives is preferably defined so that the small-sized external additive is contained in an amount of 0.3 to 1.5 mass parts per one mass part of the large-sized external additive.

The ratio of surface coverage of the toner particle with the external additive is within a range from 40 to 100%, and more preferably from 50 to 100%.

When the ratio of surface coverage is less than 40%, an effect of the external additive is not sufficiently obtained in the obtained toner. On the other hand, when the ratio exceeds 100%, the external additives are released and there are some possibility that the latent image carrier are scratched.

A status in which the ratio of surface coverage exceeds 100% herein means a status in which the external additive adheres over the entire peripheral length of the colorant particle and further stacks in a multi-layered manner.

The ratio of surface coverage is a value for evaluating existence status of the external additive which adheres on the colorant particle. The ratio is obtained as follows. The sample obtained by embedding the toner particle added with the external additive in an epoxy resin, is sliced into a thickness of 0.2 μm. The peripheral length of a portion of the colorant particle, on which the external additives are adhered, is measured by and observing the obtained slice with a transmission electron microscope. Then, the ratio of the measured peripheral length and a total peripheral length of the colorant particle, is calculated.

The small-sized external additive refers to one having a number average primary particle diameter of 30 nm or less, and more preferably 5 to 25 nm. In addition to the small-sized external additive, it is preferable to use together therewith an external additive which has a number average primary particle diameter of 15 to 70 nm, more preferably 20 to 50 nm and which is larger than the small-sized external additive preferably.

The small-sized external additive preferably comprises an inorganic fine particle, and is preferably has a hydrophobizated surface.

The number average primary particle diameter described herein means a value measured by observing 100 particles at a 2,000× magnification under a transmission electron microscope, and determined by image analysis.

As materials for composing the organic fine particle of the small-sized external additive, various inorganic oxides, nitrides and borides are preferably used.

Specific examples of the inorganic fine particle includes silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride and boron nitride.

The hydrophobic treatment of the inorganic fine particle can preferably be accomplished by using so-called coupling agents such as various titanium coupling agents and silane coupling agents; silicone oil; and metal salts of higher fatty acids such as aluminum stearate, zinc stearate and calcium stearate.

Examples of the titanium coupling agents include tetrabutyl titanate, tetraoctyl titanate, isopropyl triisostearoyl titanate, isopropyl tridecylbenzenesulfonyl titanate and bis(dioctyl pyrophosphate)oxyacetate titanate.

Examples of the silane coupling agents include γ-(2-aminoethyl)aminopropyl trimethoxy silane, γ-(2-aminoethyl)aminopropyl methyl dimethoxy silane, γ-methacryloxypropyl trimethoxy silane, N-β-(N-vinylbenzylaminoethyl)-γ-aminopropyl trimethoxy silane hydrochloride, hexamethyl disilazane, methyl trimethoxy silane, butyl trimethoxy silane, isobutyl trimethoxy silane, hexyl trimethoxy silane, octyl trimethoxy silane, decyl trimethoxy silane, dodecyl trimethoxy silane, phenyl trimethoxy silane, o-methylphenyl trimethoxy silane and p-methylphenyl trimethoxy silane.

Examples of the fatty acids include long-chained fatty acids such as undecylic acid, lauric acid, tridecylic acid, dodecylic acid, myristic acid, palmitic acid, pentadecylic acid, stearic acid, heptadecylic acid, arachic acid, montanic acid, oleic acid, linoleic acid and arachidonic acid; and the metal salts of the fatty acids include those composed of the above-described fatty acid and any metal of zinc, iron, magnesium, aluminum, calcium, sodium and lithium.

Examples of the silicone oil include dimethyl silicone oil, methyl phenyl silicone oil and amino-modified silicone oil.

Compounds for composing these treatment agents may be used in a singular manner, or in combination of two or more species if necessary.

The amount of addition of the treatment agents is preferably 1 to 10 wt % with respect to the inorganic fine powder, and more preferably 3 to 7 wt %.

Among these inorganic fine particles, silica, titania, alumina and zirconia are preferable as the small-sized external additive.

The large-sized external additive has a number average primary particle diameter of 100 nm or above, preferably 100 to 2,000 nm, and more preferably 150 to 1,000 nm.

The large-sized external additive may be any of those comprising inorganic fine particle, organic fine particle and composite fine particle, and preferably has a hydrophobizated surface.

The number average primary particle diameter described herein means a value measured by observing 100 particles at a 2,000× magnification under a transmission electron microscope, and determined by image analysis.

Materials exemplified as those for the small-sized external additive can desirably be used also for the materials for composing the inorganic fine particle for the large-sized external additive.

Among these inorganic fine particles, titania, zirconia, alumina, silica, strontium titanate, barium titanate and calcium titanate can preferably be used as the large-sized external additive.

Examples of the organic fine particle available for the large-sized external additive include resin particles such as styrene resin particle, styrene-acryl resin particle, acryl resin particle, polyester resin particle and urethane resin particle.

Although there are no special limitations on the composition of the resin particles composing the organic fine particle, vinyl-base organic fine particles are preferable since they can readily be produced by production methods such as emulsion polymerization, suspension polymerization and the like.

Among these organic fine particle, acryl resin particle, styrene-acryl resin particle and silicone resin particle are preferable for the large-sized external additive.

The resin particle composing the organic fine powder can be produced by polymerization methods such as emulsion polymerization and suspension polymerization.

The emulsion polymerization refers to a method of allowing the above-described monomers to polymerize after the monomers are added and emulsified in water containing a surfactant such as sodium dodecylbenzenesulfonate, polyvinyl alcohol, ethylene oxide adduct and sodium salt of higher alcohol sulfate.

The resin particle composing the organic fine particle can also preferably be produced by so-called non-emulsion polymerization including, for example, a technique using a reactive emulsifier such as sulfonic acid salt of amide acrylate and salts of maleic acid derivatives; a technique of polymerizing hydrophilic monomer such as vinyl acetate and methyl acrylate in the presence of a persulfate salt initiator; a technique of allowing water-soluble monomer to co-polymerize; a technique of using water-soluble resin or oligomer; a technique of using a decomposable emulsifier; and a technique of using a crosslinkable emulsifier. The non-emulsion polymerization, not causative of any influences by residual emulsifier, is particularly preferable for the case where the organic fine particle is used in a singular manner.

Monomers required for synthesizing, base on the polymerization method, the resin particle which composes the organic fine particle are preferably vinyl-containing monomers which are exemplified by styrene or styrene derivatives such as styrene, α-methylstyrene, p-chlorostyrene, 3,4-dichlorostyrene, p-phenylstyrene, p-ethylstyrene, 2,4-dimethylstyrene and p-t-butylstyrene; methacrylic ester derivatives such as methyl methacrylate, ethyl methacrylate, n-butyl methacrylate, isopropyl methacrylate, and 2-ethylhexyl methacrylate; acrylic ester derivatives such as methyl acrylate, ethyl acrylate, isopropyl acrylate, n-butyl acrylate, t-butyl acrylate, isobutyl acrylate, n-octyl acrylate and 2-ethylhexyl acrylate; olefins such as ethylene, propylene and isobutylene; halogenated vinyl compounds such as vinyl chloride, vinylidene chloride, vinyl bromide, vinyl fluoride and vinylidene fluoride; vinyl esters such as vinyl propionate and vinyl acetate; vinyl ethers such as vinyl methyl ether and vinyl ethyl ether; vinyl ketones such as vinyl methyl ketone, vinyl ethyl ketone and vinyl hexyl ketone; N-vinyl compounds such as N-vinyl carbazole, N-vinyl indole and N-vinyl pyrrolidone; vinyl compounds such as vinyl naphthalene and vinyl pyridine; and acrylic acid or methacrylic acid derivatives such as acrylonitrile, methacrylonitrile, acrylamide, N-butyl acrylamide, N,N-dibutyl acrylamide, methacrylamide, N-butyl methacrylamide and N-octadecyl acrylamide.

These vinyl-containing monomers may be used in a singular manner, or in combination of two or more species if necessary.

Examples of the polymerization initiator necessary for synthesizing the resin particle composing the organic fine particle through polymerization include peroxides such as benzoyl peroxide and lauryl peroxide, and azo compounds such as azobis(isobutylonitrile) and azobis(isovaleronitrile).

The amount of addition of these polymerization initiators is preferably 0.1 to 2 wt % with respect to the monomer.

Too small amount of the polymerization initiator may result in insufficient polymerization reaction and the obtained reaction product may contain residual monomer. On the contrary, if the polymerization initiator is used in an excessive amount, the obtained reaction product may contain decomposition products of the polymerization initiator. As a result, the toner cannot have a desirable charging property, and the reaction product may have only a small molecular weight due to increased speed of the polymerization reaction.

In the emulsion polymerization, potassium persulfate, sodium thiosulfate and the like are available as the polymerization initiator.

The "composite fine particle" described herein is one having a resin fine particle which serves as a nucleus (also referred to as "nucleus resin fine particle", hereinafter) and inorganic fine particles firmly stuck on the resin fine particle. The composite fine particle can be produced by adding inorganic fine particles to the nucleus resin fine particle and mixing them to thereby form an ordered mixture in which the inorganic fine particles are attached on the surface of the nucleus resin fine particle, and then by applying mechanical energy to the ordered mixture to thereby allow the inorganic fine particles to firmly stick on the surface of the nucleus resin fine particle.

"To firmly stick" described herein means a status of having a "ratio of sticking" (see Japanese Laid-Open Patent Publication No. 4-291352) of 25% or above.

The "ratio of sticking" is an index for expressing status of firm sticking of the inorganic fine particle, and for specifying a status of embedding of the inorganic fine particle into the nucleus resin particle. The ratio of sticking is specifically calculated by the equation below:

$$\text{Ratio of sticking} = \left(1 - \frac{Sh}{(1-x)\times Sa + x\times Sb}\right)\times 100$$

where Sa represent specific surface area of the nucleus resin fine particle, Sb represents specific surface area of the inorganic fine particle, Sh represents specific surface area of the composite fine particle comprising the nucleus resin fine particle and inorganic fine particles firmly stuck thereon, and x represents ratio of addition of the inorganic fine particles to the nucleus resin fine particle.

One exemplary method of adding the external additive to the colorant particle is such as adding the external additive to a system in which the colorant particle is incorporated, and stirring the mixture.

Stirring-and-mixing of the colorant particle and external additive is preferably proceeded by using a mechanical rotating apparatus, and more specifically, a rotary mixer such as HENSCHEL mixer can preferably be used.

Addition using the above-described apparatus is preferably carried out at a stirring speed capable of adjusting the end speed of the mixing blade (peripheral speed) equipped to the apparatus to 30 to 80 m/sec, and preferably 35 to 60 m/sec. The reason thereof is as follows. Excessively larger speed of rotation may promotes embedding of the external additive into the colorant particle during the stirring-and-mixing. As a result, the adhesion stress of the obtained toner is undesirably increased.

In the addition, control of the process energy in the apparatus is essential. The control thereof can be effected by adjusting the degree of occupancy (amount of filling) of an object toner to be processed (constituents of the toner) in the apparatus.

More specifically, for a typical case where HENSCHEL mixer is used as a mixing apparatus, it is preferable to adjust the volume/capacity ratio which expresses a ratio of occupancy of unprocessed object to be processed to the capacity of the apparatus, to 30 to 80%, and more preferably 40 to 70%.

The "volume/capacity ratio" described herein means a value in percent obtained by dividing volume calculated from static bulk density of the unprocessed object to be processed with capacity of the apparatus.

Moreover, for the case where the small-sized external additive and large-sized external additive are added as the external additive by the multi-step mixing technique, stirring-and-mixing for the first step is preferably carried out at a stirring speed of 30 to 80 m/sec and a stirring time of 30 seconds to 10 minutes, and stirring-and-mixing for the second step and thereafter is preferably carried out at a stirring speed of 30 to 80 m/sec and a stirring time of 30 seconds to 60 minutes.

Particle diameter of the toner of the present invention is preferably 3 to 9 μm in terms of volume average particle diameter, and more preferably 4.5 to 8.5 μm.

The volume average particle diameter of the toner can be measured using "COULTER COUNTER TA-II, "COULTER MULTISIZER" (manufactured by Coulter, Inc.), or a laser diffraction particle diameter analyzer "SLAD-1100" (manufactured by Shimadzu Corporation).

In the present invention, measurement and calculation were carried out using "COULTER COUNTER", an interface for outputting particle diameter distribution (manufactured by Nikkaki Co., Ltd) and a personal computer connected thereto.

The toner of the present invention preferably has a molecular weight distribution showing peaks or shoulders in a range from 100,000 to 1,000,000 and in a range from 1,000 to 50,000 when the molecular weight distribution is measured by GPC (gel permeation chromatography), and more preferably showing peaks or shoulders in a range from 100,000 to 1,000,000, a range from 25,000 to 150,000, and in a range from 1,000 to 50,000.

In the measurement of molecular weight of the resin by GPC, sample to be measured of 0.5 to 5.0 mg in weight (more specifically, 1 mg) is added with 1 ml of tetrahydrofuran (THF), and allowed to fully dissolve under stirring using a magnetic stirrer or the like in room temperature. The mixture is then filtered by a membrane filter having a pore size of 0.45 to 0.50 μm and injected into GPC.

In GPC measurement, a column is stabilized at 40° C., THF is allowed to flow at a flow rate of 1 ml/min, and measurement is carried out by injecting approximately 100 μl of the sample of 1 mg/ml concentration. The column is preferably based on combinations of commercial polystyrene gel columns. For example, any combinations of SHODEX GPC KF-801, 802, 803, 804, 805, 806 and 807, all of which are products of Showa Denko K. K., and any combinations of TSK gel G1000H, G2000H, G3000H, G4000H, G5000H, G6000H, G7000H and TSK guard column, all of which are products of Tosoh Corporation can be exemplified. The detector is preferably a refractive index detector (IR detector) or a UV detector. In the measurement, molecular weight distribution of the sample is calculated based on an analytical curve determined by using a standard monodisperse polystyrene particle. It is preferable to prepare the analytical curve using about 10 plots of polystyrene.

The toner of the present invention is preferably such as being produced by salting-out and fusing the resin particle and colorant particle in a water-base medium. In an exemplary process, the polymerizable monomer is polymerized by the suspension polymerization method to thereby prepare the resin particle, or the monomer is emulsion-polymerized in a liquid (water-base medium) added with an emulsified solution of necessary additives or polymerized according to the mini-emulsion method described later to thereby prepare the fine resin particle; a charge-controllable resin particle is added if necessary; and the resin particle is coagulated and fused by adding a coagulant such as organic solvents, salts and the like, to thereby produce the toner.

The method therefor is not specifically limited, and available methods include those disclosed in Japanese Laid-Open Patent Publication Nos. 5-265252, 6-329947 and 9-15904. More specifically, the toner of the present invention can be produced by a method of allowing dispersed particles of materials for composing the resin particle, colorant and the like, or fine particles comprising the resin, colorant and the like, to associate in the number of two or more; and can be produced particularly by a method in which these particles are allowed to disperse in water under the presence of an emulsifier, then salted out by adding a coagulant in an excessive amount higher than the critical coagulation concentration, and at the same time, by allowing the obtained polymer to fuse under heating at a temperature equal to or higher than the glass transition point of the polymer per se, to thereby form the fused particle and to gradually grow the particle diameter, then the particle growth is terminated by adding a large amount of water after a desired particle diameter was reached, the shape of the particle is controlled so as to have a smooth surface by further heating and stirring the reaction mixture, and the particle is heater to dryness while keeping them in a moist and fluidized status. It is also allowable herein to use a solvent freely miscible with water together with the coagulant.

The resin particle preferably comprises a resin containing at least both of a high-molecular-weight component having a peak or shoulder in a range of 100,000 to 1,000,000, and a low-molecular-weight component having a peak or shoulder in a range of from 1,000 and less than 50,000, and more preferably comprises a resin containing a middle-molecular-weight resin having a peak or shoulder in a range of 15,000 to 100,000.

The softening point of the resin particle is preferably 90 to 140° C.

The resin particle can be prepared by allowing polymerizable monomers to polymerize in a water-base medium typically by a granulation polymerization method such as emulsion polymerization. The polymerizable monomer used for obtaining the resin particle essentially comprises a radical polymerizable monomer and may optionally contain a crosslinkable monomer (crosslinker). It is also preferable to contain at least one radical-polymerizable monomer having an acidic polar group or one radical-polymerizable monomer having a basic polar group enumerated below.

(1) Radical-Polymerizable Monomers:

There are no special limitations on the radical-polymerizable monomers, and any known radical-polymerizable monomers are available. It is also allowable to use one, or two or more species in combination so as to satisfy any required characteristics.

Specific examples of the available monomers include aromatic vinyl monomers, (meth)acrylic ester monomers, vinyl ester monomers, vinyl ether monomers, monoolefinic monomers, diolefinic monomers and halogenated olefin monomers.

Examples of the aromatic vinyl monomers include styrene monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene and 3,4-dichlorostyrene.

Examples of the (meth)acrylate ester monomers include methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl p-hydroxyacrylate, propyl γ-aminoacrylate, stearyl methacrylate, dimethylaminoethyl methacrylate and diethylaminoethyl methacrylate.

Examples of the vinyl ester monomers include vinyl acetate, vinyl propionate and vinyl benzoate.

Examples of the vinyl ether monomers include vinyl methyl ether, vinyl ethyl ether, vinyl isobutyl ether and vinyl phenyl ether.

Examples of the monoolefinic monomers include ethylene, propylene, isobutylene, 1-butene, 1-pentene and 4-methyl-1-pentene.

Examples of the diolefinic monomers include butadiene, isoprene and chloroprene.

(2) Crosslinkable Monomers:

It is allowable to add a radical-polymerizable crosslinker in order to improve characteristics of the toner to be finally obtained. Examples of the radical-polymerizable crosslinkers include those having two or more unsaturated bonds, such as divinyl benzene, divinyl naphthalene, divinyl ether, diethylene glycol methacrylate, ethylene glycol dimethacrylate, polyethylene glycol dimethacrylate and diallyl phthalate.

(3) Radical-Polymerizable Monomers Having Acidic Polar Groups:

Examples of the radical-polymerizable monomers having an acidic polar group include α,β-ethylenic unsaturated compounds having a carboxyl group (—COOH), and α,β-ethylenic unsaturated compounds having a sulfonic acid group (—$SO_3H$).

Examples of the α,β-ethylenic unsaturated compounds having a carboxyl group include acrylic acid, methacrylic acid, fumaric acid, maleic acid, itaconic acid, cinnamic acid, maleic acid monobutyl ester, maleic acid monooctyl ester, and metal salts thereof such as sodium (Na) salts and zinc (Zn) salts.

Examples of the α,β-ethylenic unsaturated compounds having a sulfonic acid group include sulfonated styrene and sodium salt thereof; and allylsulfosuccinic acid, octyl allylsulfonate and sodium salts thereof.

(4) Radical-Polymerizable Monomers Having Basic Polar Groups:

The radical-polymerizable monomers having basic polar groups can be exemplified by (a) (meth)acrylic esters of $C_{1-12}$, preferably $C_{2-8}$, and most preferably $C_2$ aliphatic alcohols having an amine group or quaternary ammonium group; (b) (meth)acrylic acid amides, or mono- or di-alkylated (meth)acrylic acid amides substituted with $C_{1-18}$ alkyl group(s) on arbitrary N atom(s); (c) vinyl compounds substituted by a heterocyclic group having N as a ring member; and (d) N,N-diallyl-alkylamines or quaternary ammonium salts thereof. Among these, the (a) (meth)acrylic esters of aliphatic alcohols having an amine group or quaternary ammonium group are preferable.

Examples of the (a) (meth)acrylic esters of aliphatic alcohols having an amine group or quaternary ammonium group include dimethylaminoethyl acrylate, dimethylaminoethyl methacrylate, diethylaminoethyl acrylate, diethylaminoethyl methacrylate, quaternary ammonium salts of four of these compounds, 3-dimethylaminophenyl acrylate and 2-hydroxy-3-methacryloxypropyltrimethyl ammonium salt.

Examples of the (b) (meth)acrylic acid amides, or mono- or di-alkylated (meth)acrylic acid amides substituted with $C_{1-18}$ alkyl group(s) on arbitrary N atom(s) include acrylamide, N-butylacrylamide, N,N-dibutylacrylamide, piperidylacrylamide, methacrylamide, N-butylmethacrylamide, N,N-dimethylacrylamide and N-octadecylacrylamide.

Examples of the (c) vinyl compounds substituted by a heterocyclic group having N as a ring member include vinyl pyridine, vinyl pyrrolidone, vinyl N-methylpyridinium chloride and vinyl N-ethylpyridinium chloride.

Examples of the (d) N,N-diallyl-alkylamine include N,N-diallylmethylammonium chloride and N,N-diallylethylammonium chloride.

It is allowable to use any publicly-known chain transfer agent in order to adjust molecular weight of the resin particle.

There are no special limitations on the chain transfer agent, and mercapto compounds having a mercapto group such as octyl mercaptan, dodecyl mercaptan and tert-dodecyl mecaptan are popularly used. In particular, short-chained mercapto compounds are preferably in view of suppressing odor during fixation under heating, obtaining the toner having a sharp molecular weight distribution, and achieving an excellent fixation strength and anti-offset property.

Specific examples of the chain transfer agent include propyl thioglycolate, octyl thioglycolate, n-octyl mercaptopropionate and octyl mercaptan.

In the present invention, the radical polymerization initiator may be any compound provided that it is water-soluble. Examples of the initiator include persulfates (potassium persulfate, ammonium persulfate, etc.), azo compounds (4,4'-azobis(4-cyanovaleric acid) and salts thereof, 2,2'-azobis(2-amidinopropane) and salts thereof, etc.) and peroxide compounds.

The radical polymerization initiator may be combined with a reducing agent to thereby compose a redox initiator as required. Because use of the redox initiator can raise the polymerization activity, it is expected to lower the polymerization temperature and shorten the polymerization time.

The polymerization temperature can be selected to any temperatures not lower than the lowest radical generation temperature of the polymerization initiator. A temperature range of 50° C. to 90° C. is typically adopted. However, it is also allowable to proceed the polymerization at room temperature or above when any polymerization initiators capable of acting at ordinary temperatures, such as hydrogen peroxide as combined with a reducing agent (ascorbic acid, etc.), is used.

The polymerization using the above-described radical-polymerizable monomers is preferably proceeded under an oil-drop dispersion status in a water-base medium in the presence of a surfactant. Although the surfactant available here is not specifically limited, preferable examples thereof can be exemplified as follows.

Examples of ionic surfactants include sulfonates (sodium dodecylbenzene sulfonate, sodium aryl alkyl polyether sulfonate, sodium 3,3-disulfone-diphenylurea-4,4-diazobis (amino-8-naphthol-6-sulfonate), ortho-carboxybenzene-azo-dimethyl aniline, 2,2,5,5-tetramethyl triphenylmethane-4,4-diazobis(β-naphthol-6-sulfonate, etc.); salts of sulfate esters (sodium dodecylsulfate, sodium tetradecylsulfate, sodium pentadecylsulfate, sodium octylsulfate, etc.); and fatty acid salts (sodium oleate, sodium laurate, sodium caprate, sodium caprylate, sodium caproate, sodium stearate, calcium oleate, etc.).

Nonionic surfactants are also available. Specific examples thereof include polyethylene oxide, polypropylene oxide, combination of polypropylene oxide and polyethylene oxide, ester formed by polyethylene glycol and higher fatty acid, alkylphenol polyethylene oxide, ester formed by higher fatty acid and polyethylene glycol, ester formed by higher fatty acid and polypropylene oxide, and sorbitan ester.

The toner of the present invention may comprise the resin particle containing a crystalline material having a separating property as a fixation modifier as required (simply referred to as "releasing agent", hereinafter). Such a resin particle is referred to as "releasing-agent-containing resin particle", hereinafter.

The releasing agent is not specifically limited, and available examples include polyolefinic waxes such as low-molecular-weight polypropylene and low-molecular-weight polyethylene; paraffin wax; Fischer-Tropsch wax; and ester wax, where ester-base compounds expressed by General Formula (A) below are preferably used.

$$R^1—(OCO—R^2)_n \quad (A)$$

where each of $R^1$ and $R^2$ represents a hydrocarbon group which may have a substituent, and n represents an integer of 1 to 4.

In General Formula (A), each of $R^1$ and $R^2$ represents a hydrocarbon group which may have a substituent. The hydrocarbon group $R^1$ has 1 to 40 carbon atoms, preferably has 1 to 20 carbon atoms, and more preferably has 2 to 5 carbon atoms. Hydrocarbon group R2 has 1 to 40 carbon atoms, preferably has 16 to 30 carbon atoms, and more preferably has 18 to 26 carbon atoms.

Hydrocarbon groups $R^1$ and $R^2$ may be identical or may differ from each other.

In General Formula (A), n represents an integer of 1 to 4, preferably 2 to 4, more preferably 3 to 4, and most preferably 4.

Specific examples of the releasing agent are exemplified by the compounds expressed by Formulae (W1) to (W22) below.

$$CH_3—(CH_2)_{12}—COO—(CH_2)_{17}—CH_3 \quad (W1)$$

$$CH_3—(CH_2)_{18}—COO—(CH_2)_{17}—CH_3 \quad (W2)$$

$$CH_3—(CH_2)_{20}—COO—(CH_2)_{17}—CH_3 \quad (W3)$$

$$CH_3—(CH_2)_{14}—COO—(CH_2)_{19}—CH_3 \quad (W4)$$

$$CH_3—(CH_2)_{20}—COO—(CH_2)_6—O—CO—(CH_2)_{20}—CH_3 \quad (W5)$$

(W6)

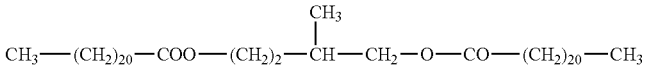

(W7)

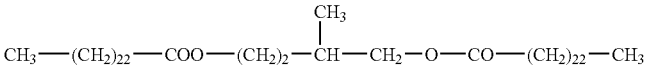

(W8)

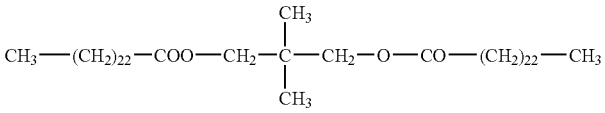

(W9)

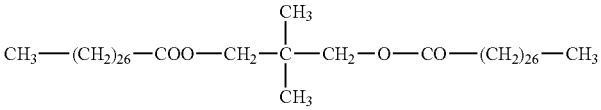

(W10)

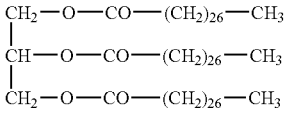

(W11)

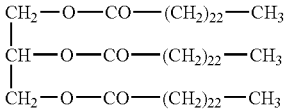

(W12)

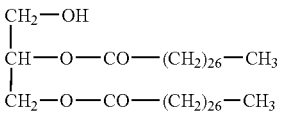

(W13)

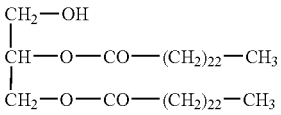

-continued (W14)

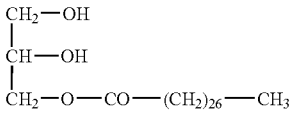

(W15)

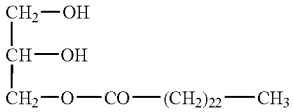

(W16)

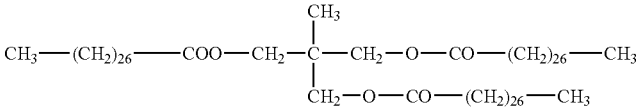

(W17)

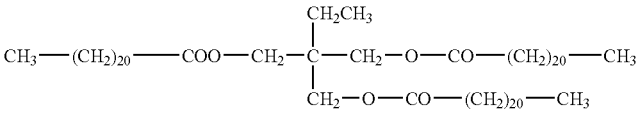

(W18)

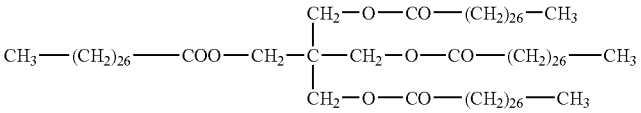

(W19)

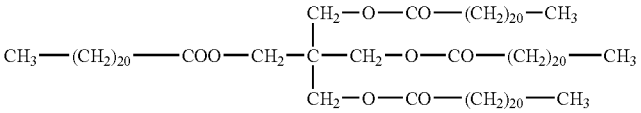

(W20)

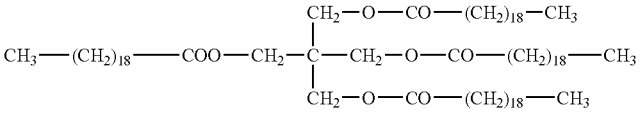

(W21)

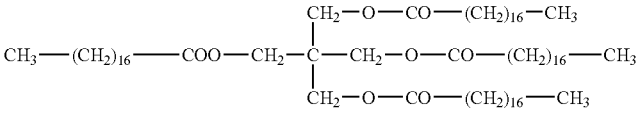

(W22)

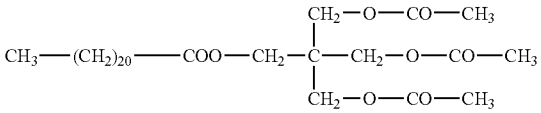

Ratio of content of the releasing agent to the entire portion of the toner is generally set to 1 to 30 wt %, more preferably set to 2 to 20 wt %, and more preferably set to 3 to 15 wt %.

Although the "releasing-agent-containing resin particle" in the present invention can be obtained by a method in which particle of a releasing agent is added during salting-out/fusion-adherence process, it is preferably obtained by at least dissolving the releasing agent in the polymerizable monomer, producing a composite resin fine particle through polymerization of the releasing-agent-containing polymerizable monomer, and subjecting the product to salting-out/fusion-adherence process together with a colorant particle.

One preferable polymerization method for obtaining the releasing-agent-containing resin particle comprises the steps of dispersing a monomer solution containing a releasing agent dissolved in a polymerizable monomer into a water-base medium containing a surfactant dissolved therein at a concentration lower than the critical micelle concentration, by using mechanical energy to prepare a dispersion liquid containing oil drops (10 to 1,000 nm); and adding a water-soluble polymerization initiator to the resultant dispersion liquid so as to proceed radical polymerization (this method is referred to as "mini-emulsion method" in this specification, hereinafter). Unlike the general emulsion polymerization, in the mini-emulsion method, the releasing agent dissolved in the polymerizable monomer is hardly eliminated, and a sufficient amount of releasing agent can be added to the resultant resin particle.

In place of adding the water-soluble polymerization initiator, when such water-soluble polymerization initiator is added, it is also allowable to add an oil-soluble polymerization initiator to the monomer solution.

Dispersion machines available herein for carrying out oil-drop dispersion using mechanical energy is not specifically limited. The examples thereof include a mechanical dispersion machine "CLEARMIX" (product of M-TECHNIQUE) which is a stirrer having a rotor capable of rotating at high speed, ultrasonic dispersion machine, mechanical homogenizer, MANTON GAULIN, and pressure homogenizer.

The colorant can be exemplified by magnetic powders such as magnetite and ferrite, and also by inorganic pigments, organic pigments and dyes. The inorganic pigments, organic pigments and dyes may be any of previously-known materials.

It is also allowable to use surface-modified colorants.

Examples of black inorganic pigment include carbon blacks such as furnace black, channel black, acetylene black, thermal black and lamp black.

These inorganic pigments may be used in a singular manner, or in combination of two or more species if necessary.

The amount of addition of the inorganic pigment is preferably 2 to 20 wt % with respect to the polymer (resin particle), and more preferably 3 to 15 wt %.

Examples of magenta or red organic pigment include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178 and C.I. Pigment Red 222.

Examples of orange or yellow organic pigment include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 74, C.I. Pigment Yellow 94, C.I. Pigment Yellow 138, C.I. Pigment Yellow 180, C.I. Pigment Yellow 185, C.I. Pigment Yellow 155 and C.I. Pigment Yellow 156.

Examples of green or cyan organic pigment include C.I. Pigment Blue 15, C.I. Pigment Blue 15:2, C.I. Pigment Blue 15:3, C.I. Pigment Blue 16, C.I. Pigment Blue 60 and C.I. Pigment Green 7.

Available example of the dye include C.I. Solvent 1, 49, 52, 58, 63, 111, 122, C.I. Solvent Yellow 19, 44, 77, 79, 81, 82, 93, 98, 103, 104, 112, 162, C.I. Solvent Blue 25, 36, 60, 70, 93, 95 or the like. Further, any mixtures thereof are also available.

These organic pigments and dyes may be used in a singular manner, or in combination of two or more species if necessary.

The amount of addition of the organic pigment is 2 to 20 wt % with respect to the polymer (resin particle), and more preferably 3 to 15 wt %.

One exemplary method of producing the toner of present invention comprises:

(1) a dissolving step for dissolving a releasing agent into a polymerizable monomer to thereby prepare a monomer solution;

(2) a dispersion step for dispersing the obtained monomer solution into a water-base medium;

(3) a polymerization step for polymerizing the obtained water-base dispersion system of the monomer solution to thereby prepare a dispersion (latex) of a resin particle containing the releasing agent;

(4) a salting-out/fusion-adherence step for obtaining a toner particle by carrying out salt-out/fuse-adhesion of the obtained resin particle and the aforementioned colorant particle in a water-base medium;

(5) a filtration-and-washing step for separating the obtained toner particle from the water-base medium by filtration, and for removing a surfactant or the like from the toner particle by washing;

(6) a drying step for drying the washed toner particle.

The method may comprise:

(7) an external additive adding step for adding an external additive to the dried toner particle.

(1) Dissolving Step

There is no special limitation on the method of dissolving the releasing agent into the polymerizable monomer.

It is also allowable to add an oil-soluble polymerization initiator, or other oil-soluble components into the monomer solution.

(2) Dispersion Step

There is no special limitation on the method of dispersing the monomer solution into the water-base medium. A preferable method refers to a method for carrying out a dispersion by mechanical energy. It is particularly preferable to disperse the monomer solution in a form of oil drops in the water-base medium containing a surfactant dissolved therein at a concentration lower than the critical micelle concentration. This is an essential mode in the mini-emulsion method.

(3) Polymerization Step

The polymerization step can basically employ particle-forming polymerization methods such as emulsion polymerization method, suspension polymerization method and seed polymerization method. The mini-emulsion method can be exemplified as one preferable polymerization method.

(4) Salting-Out/Fusion-Adherence Step

In the salting-out/fusion-adherence step, the dispersion of the resin particle obtained in the above-described polymerization step is added with the dispersion liquid of the colorant particle. The salting-out/fusion-adherence of the resin particle and colorant particle is carried out in the water-base medium.

In the salting-out/fusion-adherence step, it is also possible to fuse some internal additive particles (fine particles having a weight-average primary particle diameter of about 10 to 1000 nm) such as charge controlling agent, together with the resin particle and colorant particle.

"Salting-out/fusion-adherence" described herein means that salting-out (coagulation of particles) and fusion (disappearance of particle boundary) proceed at the same time, or means any action causing salting-out and fusion-adherence at the same time. To proceed salting-out and fusion-adherence at the same time, it is necessary to allow the particles (resin particle, colorant particle) to coagulate at a temperature not lower than the glass transition point (Tg) of the resin composing the resin particle.

The "water-base" medium used in the salting-out/fusion-adherence process refers to one containing water as a major component (50 wt % or more). Available examples of the components other than water include water-soluble organic solvents such as methanol, ethanol, isopropanol, butanol, acetone, methyl ethyl ketone and tetrahydrofurane. Among others, alcoholic organic solvent which does not solubilize the resin is particularly preferable. The examples thereof include methanol, ethanol, isopropanol and butanol.

The dispersion liquid of the resin particle used in the salting-out/fusion-adherence step can be obtained by equalizing the energy based on mechanical dispersion and repeating the dispersion, typically using a mechanical dispersion machine "CLEARMIX" (product of M-TECHNIQUE), ultrasonic dispersion machine, mechanical homogenizer, pressure dispersion machines such as MANTON GAULIN and pressure homogenizer. The weight-average primary particle diameter of the resin particle is a particle diameter of the resin particle measured using an electrophoretic light scattering spectrophotometer ELS800 (product of Otsuka Electronics Co., Ltd.).

The dispersion liquid of the colorant particle used for the salting-out/fusion-adherence step can be prepared by dispersing the colorant particle into the water-base medium. The dispersion of the colorant is proceeded in water containing a surfactant at a concentration higher than the critical micelle concentration (CMC).

While dispersion machines used for the dispersion of the colorant are not specifically limited, they are preferably exemplified by those causing shearing force by a screen which partitions a stirring chamber and a rotor which rotates at a high speed within the stirring chamber, and finely dispersing the colorant into the waterbase medium containing the surfactant using actions of the shearing force (together with actions of collision force, pressure variation, cavitation and potential core). Specific examples thereof include mechanical dispersion machine "CLEARMIX" (product of M-TECHNTQUE), ultrasonic dispersion machine, mechanical homogenizer; pressure dispersion machines such as MANTON GAULIN and pressure homogenizer; and media-aided dispersion machines such as sand grinder, GETZMANN mill and diamond mill. The surfactant used herein may be the same with those described in the above.

Weight-average particle diameter (dispersion particle diameter) of the colorant particle is selected within a range from 30 to 500 nm, and preferably within a range from 50 to 300 nm.

In the weight-average particle diameter of the colorant fine particle less than 30 nm, the colorant more likely floats in the water-base medium. In the weight-average particle diameter of the colorant fine particle exceeding 500 nm, the colorant is not appropriately dispersed in the water-base medium and easily settles. In both cases, it difficult to introduce the colorant into the toner particle. The colorant may undesirably remain free in the water-base medium. The weight-average particle diameter of the colorant fine particle is measured using an electrophoretic light scattering spectrophotometer ELS-800 (product of Otsuka Electronics Co., Ltd.).

The salting-out/fusion-adherence method has a process in which a salting-out agent which comprises a metal salt or the like is added as a coagulant at a concentration higher than the critical micelle concentration into the water-base medium containing the resin particle and colorant particle, and the mixture is then heated above the glass transition point of the resin particle to thereby proceed salting-out and fusion at the same time. It is also allowable to add an organic solvent freely miscible with water.

The coagulant can be exemplified by metal salts comprising an alkali metal (univalent metal) such as sodium, potassium and lithium; metal salts comprising a divalent metal such as alkali earth metals which include calcium and magnesium, as well as manganese and copper; and metal salts comprising a trivalent metal such as iron and aluminum. However, the metal salts comprising a divalent metal or trivalent metal are more preferable than metal salts comprising a univalent metal, because the metal salts comprising a divalent or trivalent metal show lower critical coagulation concentrations (coagulation value or coagulation point).

These metal salts may be used in a singular manner, or in combination of two or more species if necessary.

Specific examples of the coagulant include sodium chloride, potassium chloride, lithium chloride, calcium chloride, zinc chloride, copper sulfate, magnesium sulfate, manganese sulfate, aluminum chloride and iron chloride.

Any amount of addition of the coagulant may be allowable if it can attain a concentration which is not lower than the critical coagulation concentration. It is preferably set to 1.2 times or more higher than the critical coagulation concentration, and more preferably 1.5 times or more.

One case is optionally selected from two cases that the metal salt is directly added to the water-base medium containing the resin particle and colorant particle, or that the metal salt is added in a form of an aqueous solution. It is necessary for the case of addition in a form of an aqueous solution that the metal salt to be added can attain a concentration which is not lower than the critical coagulation concentration in the total volume of the water-base medium and the aqueous metal salt solution.

The "critical coagulation concentration" described herein refers to an index which expresses stability of water-base dispersion, or an index which indicates a concentration at which coagulation occurs by adding a coagulant.

The critical coagulation concentration largely vary depending on emulsified components and dispersant per se. A detailed critical coagulation concentration can be determined typically according to the technique described by Seizo Okamura et al. in "Kobunshi Kagaku (Polymer Chemistry)", 17, 601 (1960), edited by The Society of Polymer Science). Another technique in which a target particle dispersion liquid is added with a desired salt at various concentrations, ξ (zeta) potential of the dispersion liquid is measured, and the critical coagulation concentration can be determined by a salt concentration which causes change in the potential value, is also available.

Examples of the available organic solvent freely miscible with water include methanol, ethanol, 1-propanol, 2-propanol, ethylene glycol, glycerin and acetone. The preferable ones include alcohols having 3 or less carbon atoms such as methanol, ethanol, 1-propanol and 2-propanol, and 2-propanol is particularly preferable.

When Tg is the glass transition point of the resin composing the resin particle, preferable temperature of the salting-out/fusion-adherence step resides in a range from (Tg+10° C.) to (Tg+50° C.), and more preferably in a range from (Tg+15° C.) to (Tg+40° C.). It is also possible to effectively proceed the fusion by adding an organic solvent freely miscible with water to the salting-out/fusion-adherence system.

In the salting-out/fusion-adherence step, it is essential that salting-out/fusion-adherence is maintained by keeping the temperature of the dispersion liquid for a predetermined period of time after the dispersion liquid of the resin particle and colorant particle reached a temperature not lower than the glass transition point. This is successful in allowing growth of the toner particle (coagulation of the resin particle and colorant particle) and fusion (disappearance of particle boundary) to proceed in an effective manner, and in improving durability of the finally-obtained toner.

Further, it is preferable to continue the fusion under heating for ageing after the growth of the associated particles is terminated.

The ageing is a process of keeping the temperature of the system in which the growth of the associated particles is terminated, around the melting point Tm of the releasing agent, or preferably in a range from Tm to (Tm+30° C.), and of keeping stirring at a predetermined strength. By the ageing, shape of the toner particle composing the toner can be equalized.

(5) Filtration-and-Washing Step

In the filtration-and-washing step, filtration for separating the obtained toner particle from the water-base medium by filtration, and washing for removing adhering materials, such as a salting-out agent, a surfactant or the like, from the separated toner particle (a cake-like aggregate), are carried out.

Examples of the filtration method include centrifugal method, reduced-pressure filtration method using a Nutsche or the like, and filtration method using a filter press or the like, and are not specifically limited.

(6) Drying Step

This is a step for drying the washed toner particle. Examples of drier available for the step include flash-jet dryer, spray dryer, vacuum lyophilizer and reduced-pressure dryer. It is preferable to use a stationary shelf dryer, mobile shelf dryer, fluidized layer dryer, rotary dryer, stirring dryer or the like.

Moisture content of the dried toner particle is preferably 5 wt % or less, and more preferably 2 wt % or less.

For the case where the dried toner particles cohere with each other by a weak inter-particle attractive force, the aggregate may be cracked. Examples of cracking machine available herein include mechanical ones such as jet mill, HENSCHEL mixer, coffee mill and food processor.

(7) External Additive Adding Step

This step is for adding any external additives to the dried toner particle.

The toner of the present invention may also be such as those added with materials for the toner, other than the colorant and releasing agent, which can give various functions. One specific example is a charge controlling agent. There components can be added typically in such a way that they are added together with the resin particle and colorant particle in the aforementioned fusion-adherence step to thereby allow them to be incorporated into the toner, or in such a way that they are added into the resin particle itself.

The charge controlling agent may be any publicly-known material which can be dispersed into water. Specific examples thereof include nigrosine dyes, metal salts of naphthenic acid or higher fatty acids, alkoxylated amine, quaternary ammonium salt compounds, azo metal complexes, and salicylic acid metal salts or metal complexes thereof.

The toner of the present invention, has the conveyance index controlled within a specific range and having specific shape characteristics. Therefore, a thin toner film which can be frictionally charged in a highly uniform manner, can be formed on the toner carrier even under the non-magnetic single component development system. Further, the toner has an excellent supplemental property and replacement property with respect to the toner carrier. Therefore, scattering of the toner and generation of development ghost are suppressed. The toner can thus stably produce high-quality images with high text reproducibility and high-quality images are kept for a long time.

Therefore the toner of the present invention is success in stably obtaining high-quality images based on the non-magnetic single component development system.

For the case where the color toner comprising at least one of a yellow toner, a magenta toner and a cyan toner is used together with the black toner, sharp, high-quality color images can be obtained stably for a long period of time even under the non-magnetic single component development system, when the conveyance indices of the color toner and black toner individually satisfy specific relations.

The above-described toner can be desirably used as a non-magnetic single component developer, and in particular as a toner for forming color images.

According to an image forming method using a non-magnetic single component developer, an electrostatic latent image formed on the surface of an electrostatic latent image carrier is developed by the non-magnetic single component development process using the toner carried and transferred by the toner carrier to which the toner layer limiting member for limiting the amount of toner on the surface of the toner carrier is pressed. Then, the toner composing a toner image thus visualized by the development on the electrostatic latent image carrier is then transferred onto an image forming support (also referred to as "recording member", hereinafter) such as paper; and the transferred toner is then fixed under heating so as to form a visualized image on the recording member.

Figure 3:
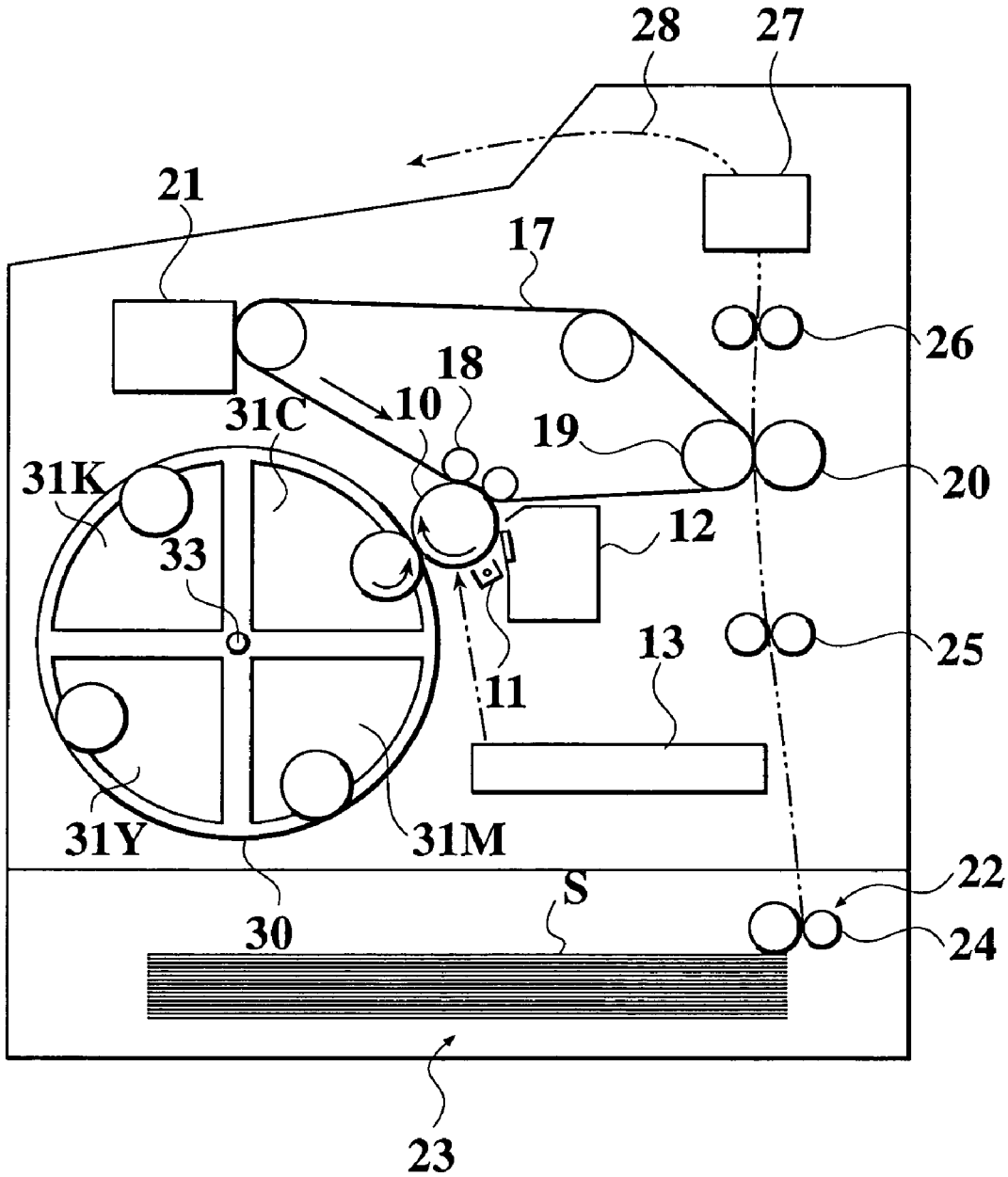
FIG. 3 is an explanatory schematic drawing showing an exemplary configuration of an image forming apparatus used for the image forming method of the present invention.

FIG. 3 is an explanatory schematic drawing showing an exemplary configuration of an image forming apparatus used for the image forming method of the present invention.

The image forming apparatus comprises an electrostatic latent image carrier (also simply referred to as "image carrier", hereinafter) 10 comprising a photosensitive drum which rotates in the clock-wise (arrow) direction in FIG. 3; a charging means 11 for uniformly charging the surface of the image carrier 10 to give a predetermined potential; a laser scanning optical system 13 typically having a laser diode, a polygon mirror and an fθ optical element incorporated therein, and configured so as to form an electrostatic latent image on the surface of the uniformly-charged image carrier 10 by carrying out scanning exposure with laser beam based on image information to be formed thereon; a development device 30 for forming a toner image by developing the electrostatic latent image formed on the surface of the image carrier 10; an endless intermediate transfer belt 17 on which the toner image formed on the image carrier 10 is primarily transferred by pressing operation of a primary transfer roller 18; a secondary transfer roller 20 for transferring the primary transferred toner image formed on the intermediate transfer belt 17 onto a recording member S such as paper locally in a portion of the intermediate transfer belt 17 supported by the supporting roller 19 under the pressure of a supporting roller 19; and a fixation unit 27 for fixing the toner image transferred onto the surface of the recording member S.

In FIG. 3, reference numeral 12 represents a cleaning means for scaling off the residual toner on the image carrier 10, reference numeral 21 represents a cleaning means for scaling off the residual toner on the intermediate transfer belt 17, reference numeral 22 represents a paper feeding means for guiding the recording member S to the intermediate transfer belt 17, reference numeral 26 represents a transfer means for transferring the recording member S having the secondary transferred toner image formed thereon towards the fixation unit 27, and reference numeral 28 represents a transfer path for transferring the recording member S having the toner image fixed thereon towards a discharging opening.

The paper feeding means 22 comprises a paper feeding tray 23 for housing the recording member S, a paper feeding roller 24 for feeding the recording member S housed in the paper feeding tray 23 sheet by sheet, and a timing roller 25 for sending the recording member S which was fed in synchronization with formation of the primary transferred toner image on the intermediate transfer belt 17, between the intermediate transfer belt 17 and the secondary transfer roller 20.

The development device 30 is a full-color development device for carrying out full-color development by supplying individual toners of cyan, magenta, yellow and black (non-magnetic single component developer) to the image carrier 10 having an electrostatic latent image formed thereon; has four development units 31C (cyan), 31M (magenta), 31Y (yellow) and 31K (black) disposed color by color around a supporting axis 33. The individual development units 31C, 31M, 31Y and 31K are configured so as to rotate around the supporting axis 33, and to be guided to a position opposing with the image carrier 10.

Figure 4:
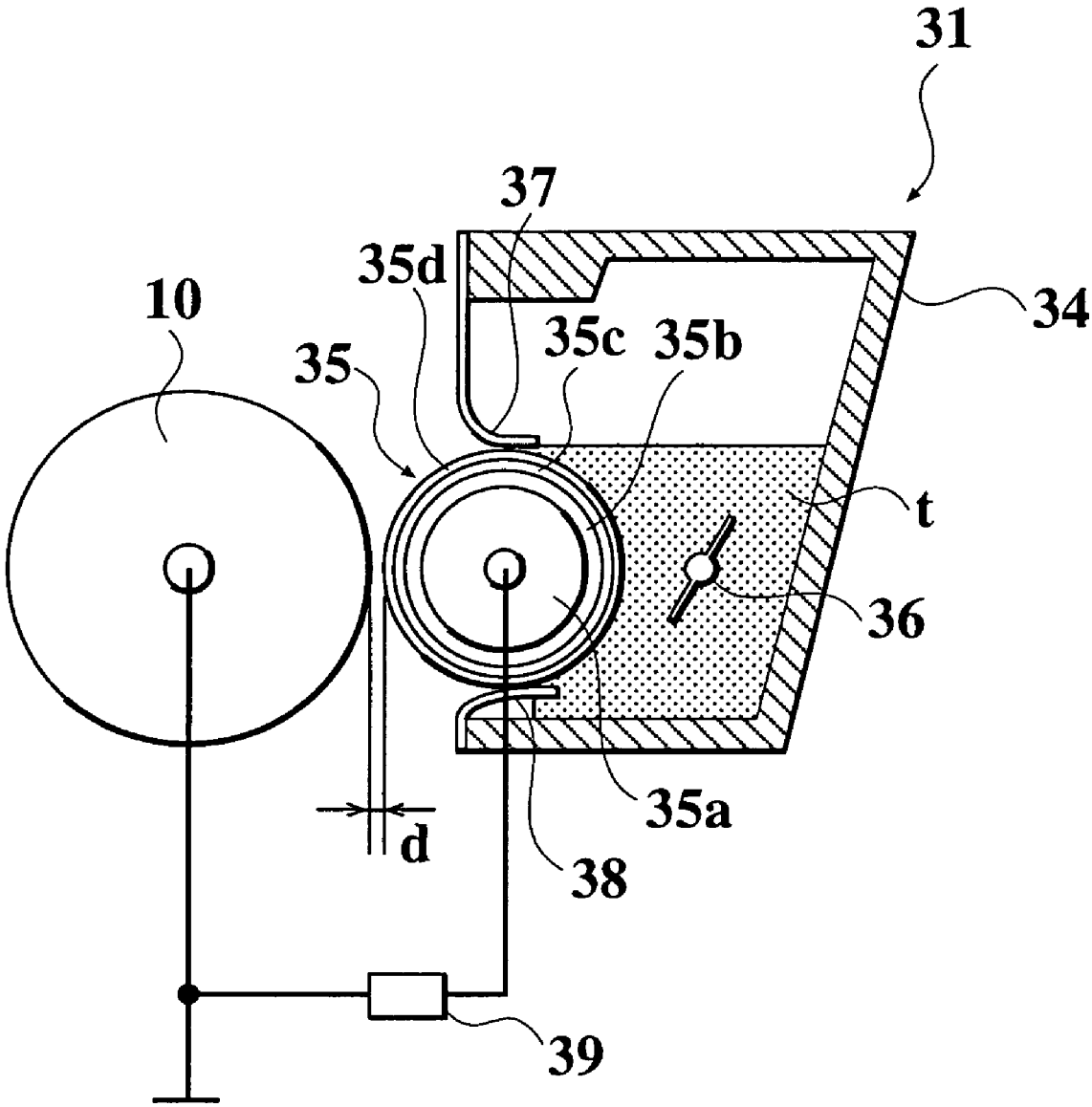
FIG. 4 is an explanatory sectional view showing a configuration of a development unit of a development device of the image forming apparatus shown in FIG. 3.

The following paragraphs will describe the development units 31C, 31M, 31Y and 31K composing the development device 30 referring to FIG. 4. All of these development units 31C, 31M, 31Y and 31K have an identical configuration.

FIG. 4 is a is an explanatory sectional view showing a configuration of the development unit of the development device of the image forming apparatus shown in FIG. 3. FIG. 4 shows a simplified expression of the development unit.

The development unit 31 comprises a development unit body 34 for housing components of the development device 30 and a toner t, a toner carrier 35 disposed so as to oppose with the image carrier 10 at a predetermined distance d, a feeding member 36 for feeding the toner to the toner carrier 35, a toner layer limiting member (also simply referred to as "limiting member", hereinafter) 37 for limiting the amount of toner carried on the surface of the toner carrier 35 and transferred, and for frictionally charging the toner carried on the surface of the toner carrier 35 and transferred, a discharging member 38 for discharging the toner remaining on the surface of the toner carrier 35 after development, and a development bias power source 39.

In the development unit 31, the toner housed in the development unit body 34 is fed by the feeding member 36 towards the toner carrier 35 as the toner carrier 35 rotates, and at the same time, the amount of toner carried on the surface of the toner carrier 35 and transferred is limited by the limiting member 37 which is brought into press-contact with the surface of the toner carrier 35 in this status, and the toner is frictionally charged.

When the toner which is given with a necessary amount of frictional charge and is carried and transferred by the toner carrier 35, is brought into the development zone which opposes with the image carrier 10 at a predetermined distance d, alternating electric field is caused by applying alternating voltage of the development bias power source 39 between the toner carrier 35 and the image carrier 10. The toner carried on the surface of the toner carrier 35 flies towards the image carrier 10. An electrostatic latent image formed on the image carrier 10 is developed by the toner.

The toner remaining on the surface of the toner carrier 35 after completion of the development is brought into contact with the discharging member 38 to erase its electric charge. The toner is separated from the surface of the toner carrier 35, and returned back into the developer body 34.

The toner carrier 35 herein is configured so that an elastic layer 35*b*, an intermediate layer 35*c* and a surface layer 35*d* are stacked in this order on the surface of a conductive base 35*a* which comprises a metal roller. It is preferable to use the toner carrier 35 having volume resistivity $\sigma 1$ of the elastic layer 35*b*, volume resistivity $\sigma 2$ of the intermediate layer 35*c* and volume resistivity $\sigma 3$ of the surface layer 35*d*, which satisfy a relation of $\sigma 2 \leqq \sigma 1 \leqq \sigma 3$, and having an arithmetic mean roughness Ra of the surface of 0.8 to 2.5 μm.

Because volume resistivity values of the elastic layer 35*b*, intermediate layer 35*c* and surface layer 35*d* composing the toner carrier 35 satisfy a specific condition, any variation in the volume resistivity al of the elastic layer 35*b* can be moderated by the intermediate layer 35*c* having the volume resistivity $\sigma 2$ smaller than the volume resistivity $\sigma 1$ of the elastic layer 35*b*, and an appropriate volume resistivity of the toner carrier 35 as a whole can be ensured by the surface layer 35*d* having the volume resistivity $\sigma 3$ larger than the volume resistivity $\sigma 1$ of the elastic layer 35*b*. This successfully prevents non-uniformity in the alternating current effected between the toner carrier 35 and image carrier 10 from occurring.

A desirable image in which non-uniform density or the like is fully suppressed can be obtained also for the case where small-sized toner is used as non-magnetic single component developer.

Because the arithmetic mean roughness Ra of the surface of the toner carrier 35 is within a specific range, the amount of toner transferred by the toner carrier 35 and supplied to the image carrier 10 in the development zone is successfully prevented from varying with every development process. Even when an extremely small-sized toner is used as a non-magnetic single component developer, non-uniformity in image density or the like can be suppressed and desirable images can be obtained.

The elastic layer 35*b* may be composed of an elastic material added with a conductive material. The examples of the elastic material include silicone rubber, isoprene rubber, butadiene rubber, butyl rubber, chloroprene rubber, nitrile rubber, styrene-butadiene rubber, acryl rubber, ethylene-propylene rubber, ethylene-propylene-diene rubber, urethane rubber, fluorine-containing rubber and thermoplastic elastomer. The examples of the conductive material include fine particle of KETJEN black, acetylene black, furnace black, titanium black and metal oxides.

The elastic layer 35*b* preferably has a volume resistivity $\sigma 1$ of $1\times10^4$ to $1\times10^6$ Ω·m.

The volume resistivity $\sigma 1$ of less than $1\times10^4$ Ω·m may ruin the formability of the elastic layer. On the contrary, the volume resistivity $\sigma 1$ exceeding $1\times10^6$ Ω·m may increase non-uniformity in the volume resistivity of the elastic layer.

The thickness of the elastic layer 35*b* is preferably in a range from 0.3 to 1.5 mm, more preferably in a range from 0.5 to 1.0 mm, and hardness of the elastic layer 35*b* is 5 to 60° in terms of JIS-A hardness, and more preferably 10 to 50°.

The intermediate layer 35*c* may be composed of silicone rubber, isoprene rubber, butadiene rubber, butyl rubber, chloroprene rubber, nitrile rubber, styrene-butadiene rubber, acryl rubber, ethylene-propylene rubber, urethane rubber, epichlorohydrin rubber, silicone resin, acryl resin, polyester resin, ABS resin, styrene resin, urethane resin or the like, added with any of conductive materials same as those available for the aforementioned elastic layer 35*b*.

The intermediate layer 35*c* preferably has a volume resistivity $\sigma 2$ of $1\times10^4$ Ω·m or below. The volume resistivity $\sigma 2$ of the intermediate layer 35*c* adjusted within the above range can successfully adjust the volume resistivity $\sigma 1$ of the elastic layer 35*b* to are in a predetermined range.

The thickness of the intermediate layer 35*c* preferably resides in a range from 5 to 30 μm, more preferably in a range from 10 to 25 μm.

The surface layer 35*d* may be composed of silicone rubber, butadiene rubber, chloroprene rubber, nitrile rubber, acryl rubber, urethane rubber, silicone resin, acryl resin, urethane resin, fluorine-containing resin, nylon resin or the like, added with any of conductive materials same as those available for the aforementioned elastic layer 35*b*.

The surface layer 35*d* preferably has a volume resistivity σ3 of $1\times10^{6}$ to $1\times10^{12}$ Ω·m.

The volume resistivity σ3 of less than $1\times10^{6}$ Ω·m may increase leakage current when the development is carried out by applying alternating electric field between the toner carrier 35 and image carrier 10. On the contrary, the volume resistivity σ3 exceeding $1\times10^{12}$ Ω·m may weaken intensity of the alternating electric field effected between the toner carrier 35 and image carrier 10 to thereby prevent the toner from being fully supplied to the image portion on the image carrier 10.

The thickness of the surface layer 35*d* preferably resides in a range from 5 to 40 μm, more preferably in a range from 10 to 30 μm.

The toner carrier 35 as described above can be manufactured so as to sequentially stack the elastic layer 35*b*, intermediate layer 35*c* and surface layer 35*d* on the conductive base 35*a*, for example, by the following method. The conductive base 35*a* is set in a metal die for forming the elastic layer. A liquid for forming the elastic layer is injected around the outer periphery of the conductive base 35*a* in the die and is cured. The die is removed to obtain the conductive base 35*a* having the elastic layer 35*b* formed thereon. A liquid for forming the intermediate layer is then coated on the surface of the formed elastic layer 35*b* to thereby form the intermediate layer 35*c*. A liquid for forming the surface layer is further coated on the surface of the intermediate layer 35*c*. The coated layer is dried to thereby form the surface layer 35*d*.

Figure 5:
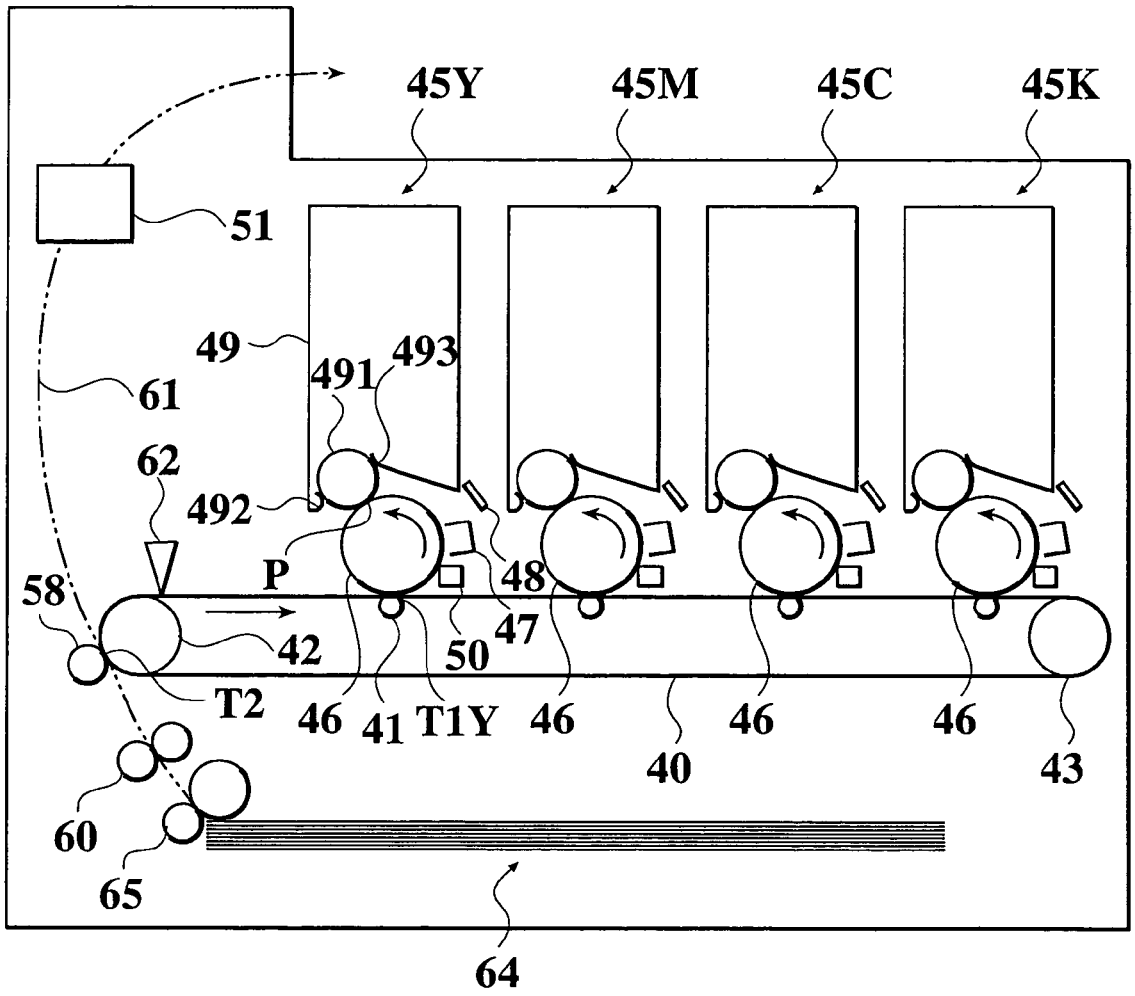
FIG. 5 is an explanatory schematic drawing showing another exemplary configuration of an image forming apparatus used for the image forming method of the present invention.

FIG. 5 is an explanatory schematic drawing showing an outline of another exemplary configuration of an image forming apparatus for implementing the image forming method of the present invention. The image forming apparatus is configured so as to sequentially transfer each of color toner images formed by each of four toner image forming units onto the intermediate transfer body to thereby make each of color toner images overlap on the intermediate transfer body. The formed color toner image (primary transferred toner image) is transferred en bloc onto an image forming support (recording member) such as transfer paper to thereby form a color toner image (secondary transferred toner image) on the recording member. The color toner image is then fixed by a fixation unit to thereby form a visualized image.

More specifically, the image forming apparatus has an endless intermediate transfer belt 40 as the intermediate transfer body. In a disposition zone for the toner image forming units along the intermediate transfer belt 40, four toner image forming units 45Y (yellow), 45M (magenta), 45C (cyan) and 45K (black) are disposed in this order along the moving direction of the intermediate transfer belt 40.

The intermediate transfer belt 40 is disposed in a state that the belt 40 is stretched over a supporting roller group typically comprising a driving roller 42 and a tension roller 43, so that the belt 40 can travel in a circulating manner by the primary transfer rollers 41 disposed for each of the toner image forming units 45Y, 45M, 45C and 45K while being oppositely in contact with each of image carriers (electrostatic latent image carrier) 46, 46, 46, 46 at the toner image forming units 45Y, 45M, 45C, 45K.

In the first toner image forming unit 45Y, a drum-like rotary image carrier 46 is provided. In the outer circumferential area of the image carrier 46, a charging means 47, a light exposure means 48 which is an image write means, and a development device 49 for carrying out the development by using the developer containing a yellow toner, are disposed along the rotating direction of the image carrier 46 in the order of the operations.

At a position on the downstream side of the development zone P along the direction of rotation of the image carrier 46, there is disposed a primary transfer roller 41 for transferring the toner image formed on the image carrier 46 to the intermediate belt 40 by applying an appropriate electric field for effecting transfer.

At a position on the downstream side of a primary transfer zone T1Y in the direction of rotation of the image carrier 46, there is disposed an image carrier cleaning unit 50.

The development device 49 comprises a toner carrier 491 disposed so as to oppose with the image carrier 46 at a predetermined distance, a feeding member (not shown) for feeding the toner to the toner carrier 491, a limiting member 492 for limiting the amount of toner carried on the surface of the toner carrier 491 and transferred, and for frictionally charging the toner carried and transferred by the surface of the toner carrier 491, a discharging member 493 for discharging the toner remaining on the surface of the toner carrier 491 after development, and a development bias power source (not shown) and the like.

The toner carrier 491 herein is configured similarly to the toner carrier 35 previously shown in FIG. 4.

Also other toner image forming units 45M, 45C and 45K are respectively configured similarly to the first toner image 45Y for yellow toner image. In each of them, the development device 49, primary transfer roller 41 and a image carrier cleaning unit 50 are disposed along the rotating direction of the image carrier 46 in the order of the operations.

At a position on the downstream side of the toner image forming unit in the moving direction of the intermediate transfer belt 40, a secondary transfer roller 58 which is a secondary transfer means is disposed so as to be pressed on the driving roller 42 via the intermediate transfer belt 40 to thereby form a secondary transfer zone T2. A secondary transfer mechanism based on contact transfer system is configured so that when an appropriate transfer bias voltage is applied by a bias voltage applying means (not shown) connected to the secondary transfer roller 58, the primary transferred toner image on the intermediate transfer belt 40 is transferred onto the recording member S which was transferred by a timing roller 60 along the transfer path 61 in synchronization with the primary transferred toner image.

At a position on the downstream side of the secondary transfer zone T2 in the moving direction of the intermediate transfer belt 40, An intermediate transfer body cleaning unit 62 having a blade cleaning mechanism is disposed. The mechanism has a plate-like intermediate transfer body cleaning blade which comprises an elastic member disposed so as to make the end edge thereof contact with the surface of the intermediate transfer belt 40, and so as to extend along the width direction of the intermediate transfer belt 40.

At a position on the downstream side of the secondary transfer zone T2 in the transfer direction of the recording member S along the transfer path 61, there is disposed a fixation unit 51 for heating and fixing a secondary transferred toner image transferred onto the recording member S.

In FIG. 5, reference numeral 64 represents a paper feeding cassette on which the recording member S is placed, reference numeral 65 represents a paper feeding roller for feeding the recording member S placed on the paper feeding cassette 64 towards the transfer path 61.

EXAMPLES

Examples of the present invention will be explained. The present invention is not limited to these examples.

It is t6 be noted that "part" described hereinafter means "mass part".

[Exemplary Preparation of Resin Particle 1]

In a flask attached with a stirrer, 72.0 g of a compound expressed by formula (W19) (referred to as "Exemplified Compound (W19)", hereinafter) was added to a mixed monomer solution containing 115.1 g of styrene, 42.0 g of n-butyl acrylate and 10.9 g of methacrylic acid, and the mixture was heated to 80° C. to thereby prepare a monomer solution.

On the other hand, in a 5,000 ml separable flask attached with a stirrer, a temperature sensor, a condenser and a nitrogen supplying device, a surfactant solution (water-base medium) is prepared by dissolving 7.08 g of an anionic surfactant (sodium dodecylbenzene sulfonate: SDS) into 2,760 g of deionized water, and the solution was heated to 80° C. under stirring at a stirring speed of 230 rpm under nitrogen gas flow.

The monomer solution (80° C.) was then mixed and dispersed into the surfactant solution (80° C.) using a mechanical dispersion machine "CLEARMIX" (product of M-TECHNIQUE) having a circulating path, to thereby obtain an emulsion liquid in which emulsified particles (oil drops) having a uniform dispersion particle diameter are dispersed.

The dispersion liquid was then added with an initiator solution prepared by dissolving 0.84 g of a polymerization initiator (potassium persulfate: KPS) into 200 g of deionized water, and the obtained system was heated and stirred at 80° C. for 3 hours so as to proceed polymerization reaction. The obtained reaction mixture was added with a solution prepared by dissolving 7.73 g of a polymerization initiator (KPS) in 240 ml of deionized water, allowed to stand for 15 minutes, heated to 80° C., and was drop-wisely added with a mixed solution containing 383.6 g of styrene, 140.0 g of n-butyl acrylate, 36.4 g of methacrylic acid and 12 g of n-octylmercaptan over 100 minutes. After the heating at 80° C. and stirring was kept for 60 minutes, the resultant system was cooled to 40° C. to thereby prepare a dispersion liquid containing Exemplified Compound (W19) (also referred to as "Latex (1)", hereinafter).

[Exemplary Preparation of Colorant Dispersion Liquid 1]

To 160 ml of deionized water, 9.2 g of sodium n-dodecylsulfate was dissolved under stirring. While keeping the solution stirred, 20 g of carbon black "MOGUL L" (product of Cabot Corporation) as a colorant was gradually added, and the mixture was then dispersed using a mechanical dispersion machine "CLEARMIX" (product of M-TECHNIQUE) to thereby prepare a dispersion liquid of a colorant particle (referred to as "Colorant Dispersion Liquid (1)", hereinafter).

Particle diameter of the colorant particle in thus obtained Colorant Dispersion Liquid (1), measured using an electrophoretic light scattering spectrophotometer "ELS-800" (product of Otsuka Electronics Co., Ltd.), was found to be 120 nm in terms of weight-average particle diameter.

[Exemplary Preparation of Colorant Dispersion Liquid 2]

A colorant dispersion liquid (referred to as "Colorant Dispersion Liquid (2)", hereinafter) was prepared similarly to as described in Exemplary Preparation of Colorant Dispersion Liquid 1, except that 20 g of a pigment "C.I. Pigment Yellow 74" was used in place of 20 g of carbon black.

Particle diameter of the colorant particle in the obtained Colorant Dispersion Liquid (2), measured using an electrophoretic light scattering spectrophotometer "ELS-800" (product of Otsuka Electronics Co., Ltd.), was found to be 120 nm in terms of weight-average particle diameter.

[Exemplary Preparation of Colorant Dispersion Liquid 3]

A colorant dispersion liquid (referred to as "Colorant Dispersion Liquid (3)", hereinafter) was prepared similarly to as described in Exemplary Preparation of Colorant Dispersion Liquid 1, except that 20 g of a quinacridone-base magenta pigment "C.I. Pigment Red 122" was used in place of 20 g of carbon black.

Particle diameter of the colorant particle in the obtained Colorant Dispersion Liquid (3), measured using an electrophoretic light scattering spectrophotometer "ELS-800" (product of Otsuka Electronics Co., Ltd.), was found to be 120 nm in terms of weight-average particle diameter.

[Exemplary Preparation of Colorant Dispersion Liquid 4]

A colorant dispersion liquid (referred to as "Colorant Dispersion Liquid (4)", hereinafter) was prepared similarly to as described in Exemplary Preparation of Colorant Dispersion Liquid 1, except that 20 g of a phthalocyanine-base cyan pigment "C.I. Pigment Blue 15:3" was used in place of 20 g of carbon black.

Particle diameter of the colorant particle in the obtained Colorant Dispersion Liquid (4), measured using an electrophoretic light scattering spectrophotometer "ELS-800" (product of Otsuka Electronics Co., Ltd.), was found to be 120 nm in terms of weight-average particle diameter.

[Exemplary Preparation of Colorant Particle K1]

Into a 5-liter reaction vessel (4-necked flask) attached with a temperature sensor, a condenser, a stirrer (double-blade-type, crossing angle=20°), and a shape monitoring device, 1,250 g (converted into solid content) of Latex (1), 2,000 ml of deionized water, and a whole volume of Colorant Dispersion Liquid (1), the liquid temperature was adjusted to 25° C., and the mixed dispersion liquid was added with a 5 mol/L aqueous sodium hydroxide solution so as to adjust pH to 10.0. A solution prepared by dissolving 52.6 g of magnesium chloride hexahydrate into 72 ml of deionized water was added under stirring at 25° C. over 10 minutes. Heating was started immediately thereafter, and this system was heated to 95° C. over 5 minutes (at a temperature elevation speed of 14° C./min)

The mixture in this status was measure for particle diameter of associated particle using COULTER COUNTER TA-II, and upon confirmation of that the volume average particle diameter reached 6.5 μm, the particle growth was terminated by adding an aqueous solution prepared by dissolving 115 g of sodium chloride into 700 ml of deionized water. The mixture was further kept under heating and stirring (number of rotation in stirring=120 rpm) at a liquid temperature of 90° C. for 8 hours to thereby continue fusion for ageing, the system was then cooled to 30° C. at a cooling speed of 10° C./min, added with hydrochloric acid to adjust pH to 3.0, and the stirring was terminated.

The produced particle was separated by filtration, repetitively washed with deionized water, centrifuged to be classified in liquid, and then dried using a flash jet dryer to thereby obtain a colorant particle having a moisture content of 1.0% (also referred to as "Colorant Particle (K1)", hereinafter).

Properties of the obtained Colorant Particle (K1) were confirmed. Results were shown in Table 2.

[Exemplary Preparations of Colorant Particles K2 to K4]

Colorant particles (also referred to as "Colorant Particles (K2) to (K4), hereinafter) were prepared similarly to as described in Exemplary Preparation of Colorant Particle (K1), except that the particle growth was terminated when the volume average particle diameters listed in Table 2 were respectively attained, and that the number of rotation in stirring, liquid temperature and stirring time under heating in the ageing were altered to those listed in Table 1.

Properties of the obtained Colorant Particles (K2) to (K4) were confirmed. Results were shown in Table 2.

[Exemplary Preparations of Colorant Particles Y1to Y4]

Colorant particles (also referred to as "Colorant Particles (Y1) to (Y4), hereinafter) were prepared similarly to as described in Exemplary Preparation of Colorant Particle (K1), except that a whole volume of Colorant Dispersion Liquid (2) was used in place of Colorant Dispersion Liquid (1), that the particle growth was terminated when the volume average particle diameters listed in Table 2 were respectively attained, and that the number of rotation in stirring, liquid temperature and stirring time under heating in the ageing were altered to those listed in Table 1.

Properties of the obtained Colorant Particles (Y1) to (Y4) were confirmed. Results were shown in Table 2.

[Exemplary Preparations of Colorant Particles M1 to M4]

Colorant particles (also referred to as "Colorant Particles (M1) to (M4), hereinafter) were prepared similarly to as described in Exemplary Preparation of Colorant Particle (K1), except that a whole volume of Colorant Dispersion Liquid (3) was used in place of Colorant Dispersion Liquid (1), that the particle growth was terminated when the volume average particle diameters listed in Table 2 were respectively attained, and that the number of rotation in stirring, liquid temperature and stirring time under heating in the ageing were altered to those listed in Table 1.

Properties of the obtained Colorant Particles (M1) to (M4)were confirmed. Results were shown in Table 2.

[Exemplary Preparations of Colorant Particles C1to C4]

Colorant particles (also referred to as "Colorant Particles (C1) to (C4), hereinafter) were prepared similarly to as described in Exemplary Preparation of Colorant Particle (K1), except that a whole volume of Colorant Dispersion Liquid (4) was used in place of Colorant Dispersion Liquid (1), that the particle growth was terminated when the volume average particle diameters listed in Table 2 were respectively attained, and that the number of rotation in stirring, liquid temperature and stirring time under heating in the ageing were altered to those listed in Table 1.

Properties of the obtained Colorant Particles (C1) to (C4) were confirmed. Results were shown in Table 2.

TABLE 1

| | Number of rotation in stirring (rpm) | Liquid temperature (° C.) | Stirring time under heating (h) |
|---|---|---|---|
| Colorant particle K1 | 120 | 90 | 8 |
| Colorant particle K2 | 140 | 90 | 8 |

TABLE 1-continued

| | Number of rotation in stirring (rpm) | Liquid temperature (° C.) | Stirring time under heating (h) |
|---|---|---|---|
| Colorant particle K3 | 150 | 88 | 6 |
| Colorant particle K4 | 120 | 95 | 10 |
| Colorant particle Y1 | 120 | 90 | 8 |
| Colorant particle Y2 | 140 | 90 | 8 |
| Colorant particle Y3 | 150 | 88 | 6 |
| Colorant particle Y4 | 120 | 95 | 10 |
| Colorant particle M1 | 120 | 90 | 8 |
| Colorant particle M2 | 140 | 90 | 8 |
| Colorant particle M3 | 150 | 88 | 6 |
| Colorant particle M4 | 120 | 95 | 10 |
| Colorant particle C1 | 120 | 90 | 8 |
| Colorant particle C2 | 140 | 90 | 8 |
| Colorant particle C3 | 150 | 88 | 6 |
| Colorant particle C4 | 120 | 95 | 10 |

[Exemplary Preparation of Colorant Particle K5: Exemplary Preparation of Comparative Colorant Particle]

A toner material consisting of 100 kg of styrene butyl acrylate copolymer resin, 10 kg of carbon black "MOGUL L" (product of Cabot Corporation), and 4 kg of polypropylene was preliminarily mixed in a HENSCHEL mixer, kneaded under fusion in a biaxial extruder, the fusedand-kneaded product was roughly cracked by a hammer mill, further ground by a jet grinding machine, and the obtained powder was repetitively classified using a pneumatic classifier until a desired particle diameter distribution is attained, to thereby obtain colorant particle (also referred to as "Colorant Particle (K5)", hereinafter) having a volume average particle diameter shown in Table 2.

Properties of the obtained Colorant Particle (K5) were confirmed. Results were shown in Table 2.

[Exemplary Preparation of Colorant Particle Y5: Exemplary Preparation of Comparative Colorant Particle]

A colorant particle (also referred to as "Colorant Particle (Y5)", hereinafter) having a volume average particle diameter shown in Table 2 was obtained similarly to as described in Exemplary Preparation of Colorant particle K5, except that 10 kg of a pigment "C.I. Pigment Yellow 74" was used in place of 10 kg of carbon black.

Properties of the obtained Colorant Particle (Y5) were confirmed. Results were shown in Table 2.

[Exemplary Preparation of Colorant Particle M5: Exemplary Preparation of Comparative Colorant Particle]

A colorant particle (also referred to as "Colorant Particle (M5)", hereinafter) having a volume average particle diameter shown in Table 2 was obtained similarly to as described in Exemplary Preparation of Colorant particle K5, except that 10 kg of a quinacridone-base magenta pigment "C.I. Pigment Red 122" was used in place of 10 kg of carbon black.

Properties of the obtained Colorant Particle (M5) were confirmed. Results were shown in Table 2.

[Exemplary Preparation of Colorant Particle C5: Exemplary Preparation of Comparative Colorant Particle]

A colorant particle (also referred to as "Colorant Particle (C5)", hereinafter) having a volume average particle diameter shown in Table 2 was obtained similarly to as described in Exemplary Preparation of Colorant particle K5, except that 10 kg of a phthalocyanine-base cyan pigment "C.I. Pigment Blue 15:3" was used in place of 10 kg of carbon black.

Properties of the obtained Colorant Particle (C5) were confirmed. Results were shown in Table 2.

TABLE 2

| | Arithmetic mean value of shape factor | Coefficient of variation of shape factor (%) | Ratio of rounded colorant particle (% by number) | Coefficient of variation of number particle diameter (%) | Volume-average particle diameter (μm) |
|---|---|---|---|---|---|
| Colorant particle K1 | 1.30 | 9 | 91 | 22 | 6.5 |
| Colorant particle K2 | 1.40 | 12 | 88 | 23 | 6.6 |
| Colorant particle K3 | 1.45 | 15 | 83 | 22 | 6.6 |
| Colorant particle K4 | 1.02 | 7 | 95 | 29 | 6.6 |
| Colorant particle K5 | 1.65 | 22 | 42 | 32 | 6.5 |
| Colorant particle Y1 | 1.32 | 10 | 92 | 22 | 6.5 |
| Colorant particle Y2 | 1.40 | 14 | 87 | 23 | 6.6 |
| Colorant particle Y3 | 1.45 | 15 | 83 | 22 | 6.6 |
| Colorant particle Y4 | 1.03 | 8 | 95 | 29 | 6.6 |
| Colorant particle Y5 | 1.64 | 24 | 40 | 32 | 6.5 |
| Colorant particle M1 | 1.31 | 9 | 94 | 22 | 6.5 |
| Colorant particle M2 | 1.42 | 13 | 88 | 23 | 6.6 |
| Colorant particle M3 | 1.45 | 15 | 83 | 22 | 6.6 |
| Colorant particle M4 | 1.02 | 8 | 94 | 29 | 6.6 |
| Colorant particle M5 | 1.63 | 23 | 41 | 32 | 6.5 |
| Colorant particle C1 | 1.31 | 9 | 91 | 22 | 6.5 |
| Colorant particle C2 | 1.42 | 13 | 82 | 23 | 6.6 |
| Colorant particle C3 | 1.45 | 15 | 83 | 22 | 6.6 |
| Colorant particle C4 | 1.02 | 8 | 94 | 29 | 6.6 |
| Colorant particle C5 | 1.65 | 22 | 42 | 32 | 6.5 |

[Exemplary Preparation of External Additive 1: Exemplary Preparation of Organic Fine Particle]

A system comprising 90 parts of methyl methacrylate, 10 parts of styrene and 300 parts of distilled water was added with a redox polymerization initiator comprising potassium persulfate and sodium thiosulfate, and with copper sulfate as an accelerator so as to attain concentrations of $5\times10^{-3}$ mole/L and $2.5\times10^{-5}$ mole/L, respectively, and the mixture was allowed to react under nitrogen gas flow at 65° C. for 2 hours. The resultant reaction product was cooled, and then resin particles having a number average primary particle diameter of 0.3 μm (also referred to as "Organic Fine Particle (1)", hereinafter) are obtained by carrying out ultrafiltration and drying.

Glass transition point of the obtained Organic Fine Particle (1) was found to be 100° C.

[Exemplary Preparation or Toner]

The external additives were added to each of the above-described colorant particles and comparative colorant particles according to formulations shown in Tables 3 to 6 below, to thereby obtain toner particles.

These particles are found to cause changes neither in shape nor in particle diameter by addition of the external additives.

In Tables 3 to 6, "Small particle 1" is a hexamethyldisilazane-treated silica particle having a number average primary particle diameter of 7 nm and a degree of hydrophobization of 62. "Small particle 2" is a hexamethyldisilazane-treated silica particle having a number average primary particle diameter of 20 nm and a degree of hydrophobization of 66. "Large particle 1" is a strontium titanate particle having a number average primary particle diameter of 300 nm. "Large particle 2" is the Organic Fine Particle (1). "Large particle 3" is a octyl trimethoxysilane-treated titania particle having a number average primary particle diameter of 100 nm and a degree of hydrophobization of 58.

It is to be noted that Small particle 1 is a small-sized external additive composed of an inorganic fine particle; Large particle 1 and Large particle 3 are large-sized external additives composed of inorganic fine particles; and Large particle 2 is a large-sized external additive composed of an organic fine particle. Small particle 2 is an external additive comprising an inorganic fine particle having an average particle diameter larger than that of Small particle 1.

"Method 1" to "Method 4" expressing methods of mixing the external additives are as follows:

"Method 1": using a HENSCHEL mixer, a first stirring-and-mixing of the small-sized external additive is carried out under conditions of a volume/capacity ratio of 55%, a stirring speed of 52 m/sec. and a stirring time of 2 minutes, and a second stirring-and-mixing of the large-sized external additive is carried out under conditions of a stirring speed of 52 m/sec and a stirring time of 20 minutes;

"Method 2": using a HENSCHEL mixer, a first stirring-and-mixing of the small-sized external additive is carried our under conditions of a volume/capicity ratio of 55%, a stirring speed of 55 m/sec, and a stirring time of 1 minute, and a second stirring-and-mixing of the large-sized external additive is carried out under conditions of a stirring speed of 55 m/sec and a stirring time of 35 minutes;

"Method 3": using a HENSCHEL mixer, a first stirring-and-mixing of the small-sized external additive is carried out under conditions of a volume/capacity ratio of 55%, a stirring speed of 45 m/sec, and a stirring time of 1 minute, and a second stirring-and-mixing of the large-sized external additive is carried out under conditions of a stirring speed of 60 m/sec and a stirring time of 35 minutes; and "Method 4": using a HENSCHEL mixer, the large-sized external additive and the small-sized external additive are added at the same time, and the stirring-and-mixing is carried out under conditions of a volume/capacity ratio of 55%, a stirring speed of 50 m/sec, and a stirring time of 40 minutes.

[Conveyance Index of Toner]

The individual resultant toners were measured for the conveyance indices according to the method described below. Results were shown in Tables 3 to 6.

(Measurement of Conveyance Index)

In the bowl of the parts feeder previously shown in FIG. 1, one gram of the toner was charged, the driving source was operated at a frequency of 120 rps and a voltage of 80 V, and durations of time between the start of operation of the driving source and the points of time when the toner reached the pan amounts 300 mg and 750 mg, respectively, were measured, and the conveyance index was calculated by the aforementioned general equation (1).

TABLE 3

| | | External additive | | | |
|---|---|---|---|---|---|
| Toner No. | Colorant particle No. | Type | Amount of addition (mass %) | Method | Conveyance index |
| Toner K1 | Colorant particle K1 | Small particle 1<br>Large particle 1 | 1.0<br>1.0 | Method 1 | 2.1 |
| Toner K2 | Colorant particle K1 | Small particle 1<br>Large particle 1 | 1.0<br>1.0 | Method 2 | 3.2 |
| Toner K3 | Colorant particle K1 | Small particle 1<br>Large particle 1 | 1.0<br>1.0 | Method 3 | 3.4 |
| Toner K4 | Colorant particle K1 | Small particle 1<br>Large particle 1 | 1.0<br>3.0 | Method 4 | 10.7 |
| Toner K5 | Colorant particle K1 | Small particle 1<br>Large particle 2 | 2.5<br>0.8 | Method 4 | 1.5 |
| Toner K6 | Colorant particle K1 | Small particle 1<br>Small particle 2<br>Large particle 1 | 1.0<br>0.8<br>1.5 | Method 1 | 3.3 |
| Toner K7 | Colorant particle K1 | Small particle 1<br>Large particle 1<br>Large particle 3 | 1.0<br>2.0<br>0.8 | Method 1 | 8.5 |
| Toner K8 | Colorant particle K2 | Small particle 1<br>Small particle 2<br>Large particle 1 | 1.0<br>0.8<br>1.5 | Method 1 | 3.6 |
| Toner K9 | Colorant particle K3 | Small particle 1<br>Small particle 2<br>Large particle 1 | 1.0<br>0.8<br>1.5 | Method 1 | 4.2 |
| Toner K10 | Colorant particle K1 | Small particle 1<br>Small particle 2<br>Large particle 1 | 1.0<br>0.8<br>1.5 | Method 2 | 4.7 |
| Toner K11 | Colorant particle K1 | Small particle 1<br>Small particle 2<br>Large particle 1 | 1.0<br>0.8<br>2.0 | Method 2 | 5.8 |
| Toner K12 | Colorant particle K1 | Small particle 1<br>Small particle 2<br>Large particle 1 | 0.8<br>0.7<br>2.5 | Method 1 | 9.5 |
| Toner K13 | Colorant particle K4 | Small particle 1<br>Small particle 2<br>Large particle 1 | 2.0<br>0.8<br>1.5 | Method 1 | 1.3 |
| Toner K14 | Colorant particle K5 | Small particle 1<br>Small particle 2<br>Large particle 1 | 1.0<br>0.8<br>3.0 | Method 1 | 11.4 |

TABLE 4

| | | External additive | | | |
|---|---|---|---|---|---|
| Toner No. | Colorant particle No. | Type | Amount of addition (mass %) | Method | Conveyance index |
| Toner Y1 | Colorant particle Y1 | Small particle 1<br>Large particle 1 | 1.0<br>2.0 | Method 1 | 5.3 |
| Toner Y2 | Colorant particle Y1 | Small particle 1<br>Large particle 1 | 1.0<br>2.0 | Method 2 | 6.3 |

TABLE 4-continued

| | | External additive | | | |
|---|---|---|---|---|---|
| Toner No. | Colorant particle No. | Type | Amount of addition (mass %) | Method | Conveyance index |
| Toner Y3 | Colorant particle Y1 | Small particle 1<br>Large particle 1 | 1.0<br>2.0 | Method 3 | 6.8 |
| Toner Y4 | Colorant particle Y1 | Small particle 1<br>Large particle 1 | 1.0<br>3.0 | Method 4 | 10.8 |
| Toner Y5 | Colorant particle Y1 | Small particle 1<br>Large particle 2 | 2.5<br>0.8 | Method 4 | 1.5 |
| Toner Y6 | Colorant particle Y1 | Small particle 1<br>Small particle 2<br>Large particle 1 | 1.0<br>0.8<br>2.0 | Method 1 | 6.4 |
| Toner Y7 | Colorant particle Y1 | Small particle 1<br>Large particle 1<br>Large particle 3 | 1.0<br>2.0<br>0.8 | Method 1 | 9.7 |
| Toner Y8 | Colorant particle Y2 | Small particle 1<br>Small particle 2<br>Large particle 1 | 1.0<br>0.8<br>2.0 | Method 1 | 6.6 |
| Toner Y9 | Colorant particle Y3 | Small particle 1<br>Small particle 2<br>Large particle 1 | 1.0<br>0.8<br>2.0 | Method 1 | 6.9 |
| Toner Y10 | Colorant particle Y1 | Small particle 1<br>Small particle 2<br>Large particle 1 | 2.0<br>0.8<br>1.0 | Method 2 | 2.5 |
| Toner Y11 | Colorant particle Y1 | Small particle 1<br>Small particle 2<br>Large particle 1 | 0.8<br>0.7<br>2.0 | Method 1 | 8.8 |
| Toner Y12 | Colorant particle Y4 | Small particle 1<br>Small particle 2<br>Large particle 1 | 2.0<br>0.8<br>1.5 | Method 1 | 1.3 |
| Toner Y13 | Colorant particle Y5 | Small particle 1<br>Small particle 2<br>Large particle 1 | 1.0<br>0.8<br>3.0 | Method 1 | 11.4 |

TABLE 5

| | | External additive | | | |
|---|---|---|---|---|---|
| Toner No. | Colorant particle No. | Type | Amount of addition (mass %) | Method | Conveyance index |
| Toner M1 | Colorant particle M1 | Small particle 1<br>Large particle 1 | 1.0<br>2.0 | Method 1 | 5.3 |
| Toner M2 | Colorant particle M1 | Small particle 1<br>Large particle 1 | 1.0<br>2.0 | Method 2 | 6.3 |
| Toner M3 | Colorant particle M1 | Small particle 1<br>Large particle 1 | 1.0<br>2.0 | Method 3 | 6.8 |
| Toner M4 | Colorant particle M1 | Small particle 1<br>Large particle 1 | 1.0<br>3.0 | Method 4 | 10.8 |
| Toner M5 | Colorant particle M1 | Small particle 1<br>Large particle 2 | 2.5<br>0.8 | Method 4 | 1.5 |
| Toner M6 | Colorant particle M1 | Small particle 1<br>Small particle 2<br>Large particle 1 | 1.0<br>0.8<br>2.0 | Method 1 | 6.4 |
| Toner M7 | Colorant particle M1 | Small particle 1<br>Large particle 1<br>Large particle 3 | 1.0<br>2.0<br>0.8 | Method 1 | 9.7 |
| Toner M8 | Colorant particle M2 | Small particle 1<br>Small particle 2<br>Large particle 1 | 1.0<br>0.8<br>2.0 | Method 1 | 6.6 |
| Toner M9 | Colorant particle M3 | Small particle 1<br>Small particle 2<br>Large particle 1 | 1.0<br>0.8<br>2.0 | Method 1 | 6.9 |
| Toner M10 | Colorant particle M1 | Small particle 1<br>Small particle 2<br>Large particle 1 | 2.0<br>0.8<br>1.0 | Method 2 | 2.5 |
| Toner M11 | Colorant particle M1 | Small particle 1<br>Small particle 2<br>Large particle 1 | 0.8<br>0.7<br>2.0 | Method 1 | 8.8 |

TABLE 5-continued

| Toner No. | Colorant particle No. | External additive Type | Amount of addition (mass %) | Method | Conveyance index |
|---|---|---|---|---|---|
| Toner M12 | Colorant particle M4 | Small particle 1 | 2.0 | Method 1 | 1.3 |
| | | Small particle 2 | 0.8 | | |
| | | Large particle 1 | 1.5 | | |
| Toner M13 | Colorant particle M5 | Small particle 1 | 1.0 | Method 1 | 11.4 |
| | | Small particle 2 | 0.8 | | |
| | | Large particle 1 | 3.0 | | |

TABLE 6

| Toner No. | Colorant particle No. | External additive Type | Amount of addition (mass %) | Method | Conveyance index |
|---|---|---|---|---|---|
| Toner C1 | Colorant particle C1 | Small particle 1 | 1.0 | Method 1 | 5.3 |
| | | Large particle 1 | 2.0 | | |
| Toner C2 | Colorant particle C1 | Small particle 1 | 1.0 | Method 2 | 6.3 |
| | | Large particle 1 | 2.0 | | |
| Toner C3 | Colorant particle C1 | Small particle 1 | 1.0 | Method 3 | 6.8 |
| | | Large particle 1 | 2.0 | | |
| Toner C4 | Colorant particle C1 | Small particle 1 | 1.0 | Method 4 | 10.8 |
| | | Large particle 1 | 3.0 | | |
| Toner C5 | Colorant particle C1 | Small particle 1 | 2.5 | Method 4 | 1.5 |
| | | Large particle 2 | 0.8 | | |
| Toner C6 | Colorant particle C1 | Small particle 1 | 1.0 | Method 1 | 6.4 |
| | | Small particle 2 | 0.8 | | |
| | | Large particle 1 | 2.0 | | |
| Toner C7 | Colorant particle C1 | Small particle 1 | 1.0 | Method 1 | 9.7 |
| | | Large particle 1 | 2.0 | | |
| | | Large particle 3 | 0.8 | | |
| Toner C8 | Colorant particle C2 | Small particle 1 | 1.0 | Method 1 | 6.6 |
| | | Small particle 2 | 0.8 | | |
| | | Large particle 1 | 2.0 | | |
| Toner C9 | Colorant particle C3 | Small particle 1 | 1.0 | Method 1 | 6.9 |
| | | Small particle 2 | 0.8 | | |
| | | Large particle 1 | 2.0 | | |
| Toner C10 | Colorant particle C1 | Small particle 1 | 2.0 | Method 2 | 2.5 |
| | | Small particle 2 | 0.8 | | |
| | | Large particle 1 | 1.0 | | |
| Toner C11 | Colorant particle C1 | Small particle 1 | 0.8 | Method 1 | 8.8 |
| | | Small particle 2 | 0.7 | | |
| | | Large particle 1 | 2.0 | | |
| Toner C12 | Colorant particle C4 | Small particle 1 | 2.0 | Method 1 | 1.3 |
| | | Small particle 2 | 0.8 | | |
| | | Large particle 1 | 1.5 | | |
| Toner C13 | Colorant particle C5 | Small particle 1 | 1.0 | Method 1 | 11.4 |
| | | Small particle 2 | 0.8 | | |
| | | Large particle 1 | 3.0 | | |

[Exemplary Preparation of Toner Carrier 1]

An aluminum-made roller having an outer diameter of 14 mm was obtained as a conductive base. The aluminum-made roller was set in a die for forming electric layer. A liquid for forming the elastic layer, described below, was injected around the outer periphery of the aluminum-made roller in the die and then heated at 120° C. for 5 minutes to thereby allow it to cure. The composite was further heated as being released from the die for 150° C. for 1 hour. Further, the surface of the obtained composite was polished using a traverse cylindrical polishing machine to thereby form an elastic layer of 1 mm thick on the outer circumference of the aluminum-made roller.

After the surface of the elastic layer formed on the outer periphery of the aluminum-made roller was then treated with a silane coupling agent, a coated film was formed by spraying a coating liquid for forming the intermediate layer described later on the elastic layer. The coated film was dried to thereby form the intermediate layer of 10 μm thick on the elastic layer.

Further, on the surface of the intermediate layer formed on the surface of the elastic layer on the outer periphery of the aluminum-made roller, a coated film was formed by spraying a coating liquid for forming the surface layer described later. The coated film was dried to thereby form the surface layer of 18 μm thick on the intermediate layer. By this process, the toner carrier (also referred to as "Toner Carrier (1)", hereinafter) having the elastic layer of 1 mm thick, the intermediate layer of 10 μm thick, and the surface layer of 18 μm thick which are stacked in this order, was produced on the conductive base.

(Preparation of Coating Liquid for Forming Elastic Layer)

Fifty parts by mass each of liquid A and liquid B of liquid-type silicone rubber "KE-1935" (product of Shin-Etsu Chemical Co., Ltd.) and 8 parts by mass of conductive carbon black "#3030" (product of Mitsubishi Chemical Corporation) were mixed and defoamed in a mixing/defoaming apparatus "HYBRID mixer H" (product of Keyence Corporation) for 3 minutes to thereby prepare a coating liquid for forming the elastic layer.

(Preparation of Coating Liquid for Forming Intermediate Layer)

To a solution obtained by dissolving 5 parts by mass of styrene-butadiene elastomer "AR-S39948A" (product of ARONKASEI Co., Ltd.) into 100 parts by mass of toluene as a solvent, 0.2 parts by mass of a conductive carbon black "KETJEN BLACK" (product of Lion-Akzo Co., Ltd.) and 0.3 parts by mass of a conductive carbon black "PRINTE XE2" (product of Degussa Corporation) were added. The obtained mixed solution was uniformly dispersed using a mixing/defoaming apparatus "HYBRID mixer H" (product of Keyence Corporation) to thereby prepare a coating liquid for forming the intermediate layer.

(Preparation of Coating Liquid for Forming Surface Layer)

One hundred parts by mass of polyurethane resin emulsion "YODOSOLRX-7" having a solid content of 35 wt % (product of Nippon NSC Ltd.), 0.35 parts by mass of a conductive carbon black "VALCAN XC-7" (product of Cabot Corporation), and 3.5 parts by mass of a roughening particle "SILICA SYLOPHERE 470" (product of Fuji Silysia Chemical Ltd.) were mixed and defoamed in a mixing/defoaming apparatus "HYBRID mixer H" (product of Keyence Corporation) for 3 minutes to thereby prepare a coating liquid for forming the surface layer.

Volume resistivity of the individual layers composing the obtained Toner Carrier (1) and arithmetic mean roughness of the toner carrier were measured by the techniques described below. Results were shown in Table 7.

(Measurement of Volume Resistivity of Individual Layers)

Volume resistivity of the elastic layer and surface layer were measured by forming a layer to be measured (elastic layer or surface layer) respectively on an aluminum-made roller similarly to as described in the Exemplary Preparation of Toner Carrier 1, and by pressing a roller-formed metal electrode to the layer to be measured to apply a voltage of 100 V to the layer to be measured.

Volume resistivity of the intermediate layer was measured by forming a layer to be measured (intermediate layer) on an aluminum-made roller similarly to as described in the Exemplary Preparation of Toner Carrier 1, and by pressing a roller-formed metal electrode to the layer to be measured to apply a voltage of 10 V to the layer to be measured.

(Measurement of Arithmetic Mean Roughness)

By using a surface roughness measuring instrument "SURFCOM 1400A" (product of Tokyo Seimitsu Co., Ltd.), arithmetic mean roughness of the Toner Carrier (1) was measured at a scanning speed of 0.3 mm/s, a cut-off of 0.8 mm, a length of measurement of 4 mm, and a measurement pressure of 0.7 mm/N.

[Exemplary Preparation of Toner Carrier 2]

A toner carrier (also referred to as "Toner Carrier (2)", hereinafter) was prepared similarly to as described in Exemplary Preparation of Toner Carrier 1, except that 3.5 parts by mass of a roughening particle "SILICA SYLOPHERE 380" (product of Fuji Silysia Chemical Ltd.) was used in the preparation of the coating liquid for forming the surface layer, in place of 3.5 parts by mass of a roughening particle "SILICA SYLOPHERE 470" (product of Fuji Silysia Chemical Ltd.)

Volume resistivity of the individual layers composing the obtained Toner Carrier (2) and arithmetic mean roughness of the toner carrier were measured similarly to as described in Exemplary Preparation of Toner Carrier 1. Results were shown in Table 7.

[Exemplary Preparation of Toner Carrier 3]

A toner carrier (also referred to as "Toner Carrier (3)", hereinafter) was prepared similarly to as described in Exemplary Preparation of Toner Carrier 1, except that 5.0 parts by mass of a roughening particle "Methylsilicone MSP-150" (product of Nikko Fine Products Co., Ltd.) was used in the preparation of the coating liquid for forming the surface layer, in place of 3.5 parts by mass of a roughening particle "SILICA SYLOPHERE 470" (product of Fuji Silysia Chemical Ltd.)

Volume resistivity of the individual layers composing the obtained Toner Carrier (3) and arithmetic mean roughness of the toner carrier were measured similarly to as described in Exemplary Preparation of Toner Carrier 1. Results were shown in Table 7.

[Exemplary Preparation of Toner Carrier 4]

A toner carrier (also referred to as "Toner Carrier (4)", hereinafter) was prepared similarly to as described in Exemplary Preparation of Toner Carrier 1, except that 4.0 parts by mass of a roughening particle "SILICA SYLOPHERE #440" (product of Fuji Silysia Chemical Ltd.) was used in the preparation of the coating liquid for forming the surface layer, in place of 3.5 parts by mass of a roughening particle "SILICA SYLOPHERE 470" (product of Fuji Silysia Chemical Ltd.).

Volume resistivity of the individual layers composing the obtained Toner Carrier (4) and arithmetic mean roughness of the toner carrier were measured similarly to as described in Exemplary Preparation of Toner Carrier 1. Results were shown in Table 7.

[Exemplary Preparation of Toner Carrier 5]

A toner carrier (also referred to as "Toner Carrier (5)", hereinafter) was prepared similarly to as described in Exemplary Preparation of Toner Carrier 1, except that 4.0 parts by mass of a roughening particle "Acryl fine particle EAX-20" (product of Sekisul Plastics Co., Ltd.) was used in the preparation of the coating liquid for forming the surface layer, in place of 3.5 parts by mass of a roughening particle "SILICA SYLOPHERE 470" (product of Fuji Silysia Chemical Ltd.)

Volume resistivity of the individual layers composing the obtained Toner Carrier (5) and arithmetic mean roughness of the toner carrier were measured similarly to as described in Exemplary Preparation of Toner Carrier 1. Results were shown in Table 7.

TABLE 7

| | Volume resistivity (Ω· cm) | | | Arithmetic mean |
|---|---|---|---|---|
| | σ1 | σ2 | σ3 | roughness Ra (μm) |
| Toner carrier 1 | $4.8 \times 10^4$ | $1.2 \times 10^3$ | $2.7 \times 10^8$ | 1.7 |
| Toner carrier 2 | $4.8 \times 10^4$ | $1.2 \times 10^3$ | $2.7 \times 10^8$ | 1.0 |
| Toner carrier 3 | $4.8 \times 10^4$ | $1.2 \times 10^3$ | $2.7 \times 10^8$ | 2.1 |
| Toner carrier 4 | $4.8 \times 10^4$ | $1.2 \times 10^3$ | $2.7 \times 10^8$ | 0.7 |
| Toner carrier 5 | $4.8 \times 10^4$ | $1.2 \times 10^3$ | $2.7 \times 10^8$ | 2.6 |

[Copying Tests 1 to 17]

By using each of the toners listed in Tables 8 and 9 as a non-magnetic single component developer, and by using an image forming apparatus having either configuration shown in FIG. 3 or FIG. 5 as listed in Tables 8 and 9, and having a toner carrier listed in Tables 8 and 9, 10,000 copies of full-color image having a pixel ratio of 30% were formed on A4-sized sheets of paper under a constant temperature and high humidity atmosphere conditioned at a temperature of 30° C. and relative humidity of 85% RH. On the obtained 10,000th copy, the image was visually evaluated for reproducibility of thin lines per 1 mm width to thereby confirm text reproducibility which expresses thin line reproducibility of the text portion (black). The image was also evaluated for fogging density in which absolute image density values were measured at arbitrary 20 points on the white portion having no fixed image printed thereon using a Macbeth reflection densitometer "RD-918", an average value of the density values were calculated, and the average value was compared with an average value of absolute image density values measured at arbitrary 20 points on the unprinted transfer sheet. A difference between both average values was defined as fogging density.

The image was also evaluated for development ghost in which a full color patch image (10 m×10 m) having a pixel ratio of 100% was formed on a A4-sized sheet of paper under a warm and humid atmosphere conditioned at a temperature of 30° C. and a relative humidity of 85% RH, a half-tone image having a pixel ratio of 20% was then formed, and the obtained half-tone image was visually inspected for any unfixed toner area ascribable to shape of the patch image. The unfixed toner area was defined as development ghost.

The image was further evaluated for non-uniformity in image density in which a full-sized solid black image was formed on a A4-sized sheet of paper under a warm and humid atmosphere conditioned at a temperature of 30° C. and a relative humidity of 85% RH, and maximum reflection density and minimum reflection density were obtained by measuring absolute image density values at arbitrary 10 points using a Macbeth reflection densitometer "RD-918", and by calculating an average value thereof. The difference between them was defined as non-uniformity in image density.

Results were shown in Table 10.

TABLE 8

| | Developer | Toner carrier | Image forming apparatus |
|---|---|---|---|
| Copying test 1 | Toner K1<br>Toner Y1<br>Toner M1<br>Toner C1 | Toner carrier 1 | Apparatus in FIG. 3 |
| Copying test 2 | Toner K1<br>Toner Y1<br>Toner M1<br>Toner C1 | Toner carrier 2 | Apparatus in FIG. 3 |
| Copying test 3 | Toner K1<br>Toner Y1<br>Toner M1<br>Toner C1 | Toner carrier 3 | Apparatus in FIG. 3 |
| Copying test 4 | Toner K2<br>Toner Y2<br>Toner M2<br>Toner C2 | Toner carrier 1 | Apparatus in FIG. 3 |
| Copying test 5 | Toner K3<br>Toner Y3<br>Toner M3<br>Toner C3 | Toner carrier 1 | Apparatus in FIG. 3 |
| Copying test 6 | Toner K6<br>Toner Y6<br>Toner M6<br>Toner C6 | Toner carrier 1 | Apparatus in FIG. 3 |
| Copying test 7 | Toner K7<br>Toner Y7<br>Toner M7<br>Toner C7 | Toner carrier 1 | Apparatus in FIG. 3 |
| Copying test 8 | Toner K8<br>Toner Y8<br>Toner M8<br>Toner C8 | Toner carrier 1 | Apparatus in FIG. 3 |
| Copying test 9 | Toner K9<br>Toner Y9<br>Toner M9<br>Toner C9 | Toner carrier 1 | Apparatus in FIG. 3 |
| Copying test 10 | Toner K10<br>Toner Y9<br>Toner M9<br>Toner C9 | Toner carrier 1 | Apparatus in FIG. 5 |
| Copying test 11 | Toner K11<br>Toner Y11<br>Toner M11<br>Toner C11 | Toner carrier 1 | Apparatus in FIG. 5 |

TABLE 9

| | Developer | Toner carrier | Image forming apparatus |
|---|---|---|---|
| Copying test 12 | Toner K12<br>Toner Y10<br>Toner M10<br>Toner C10 | Toner carrier 1 | Apparatus in FIG. 5 |
| Copying test 13 | Toner K1<br>Toner Y1<br>Toner M1<br>Toner C1 | Toner carrier 1 | Apparatus in FIG. 5 |
| Copying test 14 | Toner K4<br>Toner Y4<br>Toner M4<br>Toner C4 | Toner carrier 4 | Apparatus in FIG. 3 |
| Copying test 15 | Toner K5<br>Toner Y5<br>Toner M5<br>Toner C5 | Toner carrier 5 | Apparatus in FIG. 3 |
| Copying test 16 | Toner K13<br>Toner Y12<br>Toner M12<br>Toner C12 | Toner carrier 1 | Apparatus in FIG. 3 |

TABLE 9-continued

| | Developer | Toner carrier | Image forming apparatus |
|---|---|---|---|
| Copying test 17 | Toner K14<br>Toner Y13<br>Toner M13<br>Toner C13 | Toner carrier 1 | Apparatus in FIG. 3 |

TABLE 10

| | Fogging density | Text reproducibility (lines/mm) | Development ghost | Non-uniformity in image density |
|---|---|---|---|---|
| Copying test 1 | 0.001 | 8 | None | 0.01 |
| Copying test 2 | 0.001 | 8 | None | 0.01 |
| Copying test 3 | 0.001 | 8 | None | 0.01 |
| Copying test 4 | 0.001 | 8 | None | 0.01 |
| Copying test 5 | 0.001 | 8 | None | 0.01 |
| Copying test 6 | 0.001 | 8 | None | 0.01 |
| Copying test 7 | 0.006 | 7 | None | 0.03 |
| Copying test 8 | 0.001 | 8 | None | 0.01 |
| Copying test 9 | 0.001 | 8 | None | 0.01 |
| Copying test 10 | 0.001 | 8 | None | 0.01 |
| Copying test 11 | 0.001 | 8 | None | 0.01 |
| Copying test 12 | 0.007 | 6 | None | 0.02 |
| Copying test 13 | 0.001 | 8 | None | 0.01 |
| Copying test 14 | 0.013 | 7 | Found | 0.23 |
| Copying test 15 | 0.014 | 4 | Found | 0.10 |
| Copying test 16 | 0.012 | 4 | Found | 0.10 |
| Copying test 17 | 0.012 | 7 | Found | 0.25 |

It was confirmed from the results that, in Copying Test (1) to (6) and (8) to (11), the non-magnetic single component development system could provide full-color images having a higher quality in a more stable manner, because the developers used in the Tests are those based on the association process and have conveyance indices controlled within a specific range; the color toners and black toner satisfy specific conditions; and the toner carriers have specific configurations and satisfy specific conditions.

Because the toner of the present invention has specific shape properties and conveyance index controlled within a specific range, it can form a thin toner layer which can be frictionally charged in a highly uniform manner on the toner carrier even under the non-magnetic single component development system. Further, it has an excellent supplemental property and replacement property with respect to the toner carrier.

The toner of the present invention can thus stably produce images with high quality based on the non-magnetic single component development system.

According to the image forming method of the present invention, because the toner is used as a non-magnetic single component developer, high-quality images can be stably obtained.

Further, in the image forming method of the present invention, when the toner carriers has a specific configurations and satisfies specific conditions, it is possible to obtain high-quality images more stably by the non-magnetic single component development system.

Further, according to the image forming method of the present invention, even when a color image is formed by using various types of color toners, each conveyance index of the color toners is controlled so as to be within the specific range. Even though a color image is formed by using the non-magnetic single component development system, it is possible to form an image having high quality for a long time by using the color toners and black toner which mutually have specific relations.

The entire disclosure of Japanese Patent Application No. Tokugan 2002-273210 filed on Sep. 19, 2002 including specification, claims drawings and summary are incorporated herein by reference in its entirety.

What is claimed is:

1. A toner comprising toner particles having a volume average particle diameter of 3 to 9 μm, an arithmetic mean value of shape factor of 1.1 to 1.5, a coefficient of variation of shape factor of 16% or less, a ratio of rounded toner particle of 50% by number or more, a coefficient of variation of number particle diameter distribution of 26% or less, and a conveyance index of 2.0 to 10.0, wherein the toner comprises external additives which are a small-sized external additive having a number average primary particle diameter of 30 nm or less and an external additive having a number average primary particle diameter of 100 nm to 2,000 nm.

2. The toner of claim 1, having a peak or shoulder respectively in a molecular weight distribution range from 100,000 to 1,000,000, and from 1,000 to 50,000.

3. The toner of claim 1, comprising a large-sized external additive having a number average primary particle diameter larger than that of the small-sized external additive, and of 15 to 70 nm.

4. The toner of claim 3, wherein the small-sized external additive is contained in an amount of 0.3 to 1.5 mass parts per one mass part of the large-sized external additive.

5. The toner of claim 1, wherein the toner is obtained by a salting-out/fusion-adherence process of a resin particle and a colorant particle proceeded in a water-base medium and the resin particle has a softening point of 90 to 140° C.

6. The toner of claim 1, wherein the conveyance index is within a range from 2.0 to 9.0.

7. The toner of claim 1, wherein the conveyance index is within a range of from 2.0 to 8.0.

8. The toner of claim 1, wherein a ratio of surface coverage of the toner particle with the external additives is of 40 to 100%.

9. The toner of claim 1, wherein the number average primary particle diameter of the small-sized external additive is 5 to 25 nm.

10. The toner of claim 1, comprising at least one of polyolefinic waxes, paraffin wax, Fischer-Tropsch wax or ester wax, where the ester wax is expressed by Formula:

$$R1\text{-}(OCO\text{—}R2)n,$$

where each of R1 and R2 represents a hydrocarbon group which may have a substituent, and n represents an integer of 1 to 4.

11. A toner comprising toner particles having a volume average particle diameter of 3 to 9 μm, an arithmetic mean value of shape factor of 1.1 to 1.5, a coefficient of variation of shape factor of 16% or less, a ratio of rounded toner particle of 50% by number or more, a coefficient of variation of number particle diameter distribution of 26% or less, and a conveyance index of 2.0 to 10.0, wherein the toner is obtained by a salting-out/fusion-adherence process of a resin particle and a colorant particle proceeded in a water-base medium and the resin particle has a softening point of 90 to 140° C.

12. The toner of claim 11, containing external additives having different number average primary particle diameters.

13. The toner of claim 12, wherein one of the external additives is a small-sized external additive having a number average primary particle diameter of 30 nm or less.

14. The toner of claim 13, wherein one of the external additives is a large-sized external additive having a number average primary particle diameter larger than that of the small-sized external additive, and of 15 to 70 nm.

15. The toner of claim 14, wherein the small-sized external additive is contained in an amount of 0.3 to 1.5 mass parts per one mass part of the large-sized external additive.

16. The toner of claim 14, wherein a ratio of surface coverage of the toner particle with the external additives is of 40 to 100%.

17. A toner comprising toner particles having a volume average particle diameter of 3 to 9 μm, an arithmetic mean value of shape factor of 1.1 to 1.5, a coefficient of variation of shape factor of 16% or less, a ratio of rounded toner particle of 50% by number or more, a coefficient of variation of number particle diameter distribution of 26% or less, and a conveyance index of 2.0 to 10.0, wherein the toner comprises external additives and a ratio of surface coverage of the toner particle with the external additives is of 40 to 100%.

18. A non-magnetic single component developer comprising toner particles having a volume average particle diameter of 3 to 9 μm, an arithmetic mean value of shape factor of 1.1 to 1.5, a coefficient of variation of shape factor of 16% or less, a ratio of rounded toner particle of 50% by number or more, a coefficient of variation of number particle diameter distribution of 26% or less, and a conveyance index of 2.0 to 10.0, wherein the toner comprises external additives which are a small-sized external additive having a number average primary particle diameter of 30 nm or less and an external additive having a number average primary particle diameter of 100 nm to 2,000 nm.

19. The developer of claim 18, wherein the conveyance index is within a range from 2.0 to 9.0.

20. The developer of claim 18, wherein the toner is obtained by a salting-out/fusion-adherence process of a resin particle and a colorant particle proceeded in a water-base medium and the resin particle has a softening point of 90 to 140° C.

21. A non-magnetic single component developer comprising toner particles having a volume average particle diameter of 3 to 9 μm, an arithmetic mean value of shape factor of 1.1 to 1.5, a coefficient of variation of shape factor of 16% or less, a ratio of rounded toner particle of 50% by number or more, a coefficient of variation of number particle diameter distribution of 26% or less, and a conveyance index of 2.0 to 10.0, wherein the toner is obtained by a salting-out/fusion-adherence process of a resin particle and a colorant particle proceeded in a water-base medium and the resin particle has a softening point of 90 to 140° C.

22. The developer of claim 21, containing external additives having different number average primary particle diameters.

23. The developer of claim 22, wherein one of the external additives is a small-sized external additive having a number average primary particle diameter of 30 nm or less.

24. The developer of claim 21, wherein the conveyance index is within a range from 2.0 to 9.0.

* * * * *